United States Patent [19]

Tanaka et al.

[11] 3,985,436

[45] Oct. 12, 1976

[54] ELECTROPHOTOGRAPHIC COPYING APPARATUS

[75] Inventors: Susumu Tanaka, Sakai; Yuji Enoguchi, Osaka; Masaya Ogawa, Sakai; Hidetoshi Kawabata, Tondabayashi; Takaji Kurita, Kawachinagano; Takao Fujiwara, Sakai; Hiroshi Murasaki, Sakai; Kenichi Wada, Sakai, all of Japan

[73] Assignee: Minolta Camera Kabushiki Kaisha, Osaka, Japan

[22] Filed: June 9, 1975

[21] Appl. No.: 584,892

[30] Foreign Application Priority Data

June 25, 1974 Japan ..... 49-73016
July 29, 1974 Japan ..... 49-90966

[52] U.S. Cl. ..... 355/8; 355/3 DD; 355/15

[51] Int. Cl.[2] ..... G03G 15/30

[58] Field of Search ..... 355/3 R, 3 DD, 3 DR, 355/8, 11, 15

[56] References Cited

UNITED STATES PATENTS

| | | | |
|---|---|---|---|
| 3,521,950 | 7/1970 | Gardner et al. | 355/3 BE |
| 3,667,840 | 6/1972 | Engel et al. | 355/15 X |
| 3,738,743 | 6/1973 | Hoffman et al. | 355/3 SH |

*Primary Examiner*—Joseph F. Peters, Jr.
*Assistant Examiner*—Kenneth C. Hutchison
*Attorney, Agent, or Firm*—Wenderoth, Lind & Ponack

[57] ABSTRACT

An electrophotographic copying apparatus in which a photoreceptor, a developing device and a cleaning device for residual toner particles are integrally incorporated in a casing as one unit so as to be releasably inserted into the copying apparatus housing for efficient replacement and maintenance of such major components. The copying apparatus is further provided with a copy paper sheet feed device which can be changed over from manual sheet insertion to automatic sheet feeding or vice versa by simply one operation.

18 Claims, 21 Drawing Figures

ELECTROPHOTOGRAPHIC COPYING APPARATUS

Figure 1:
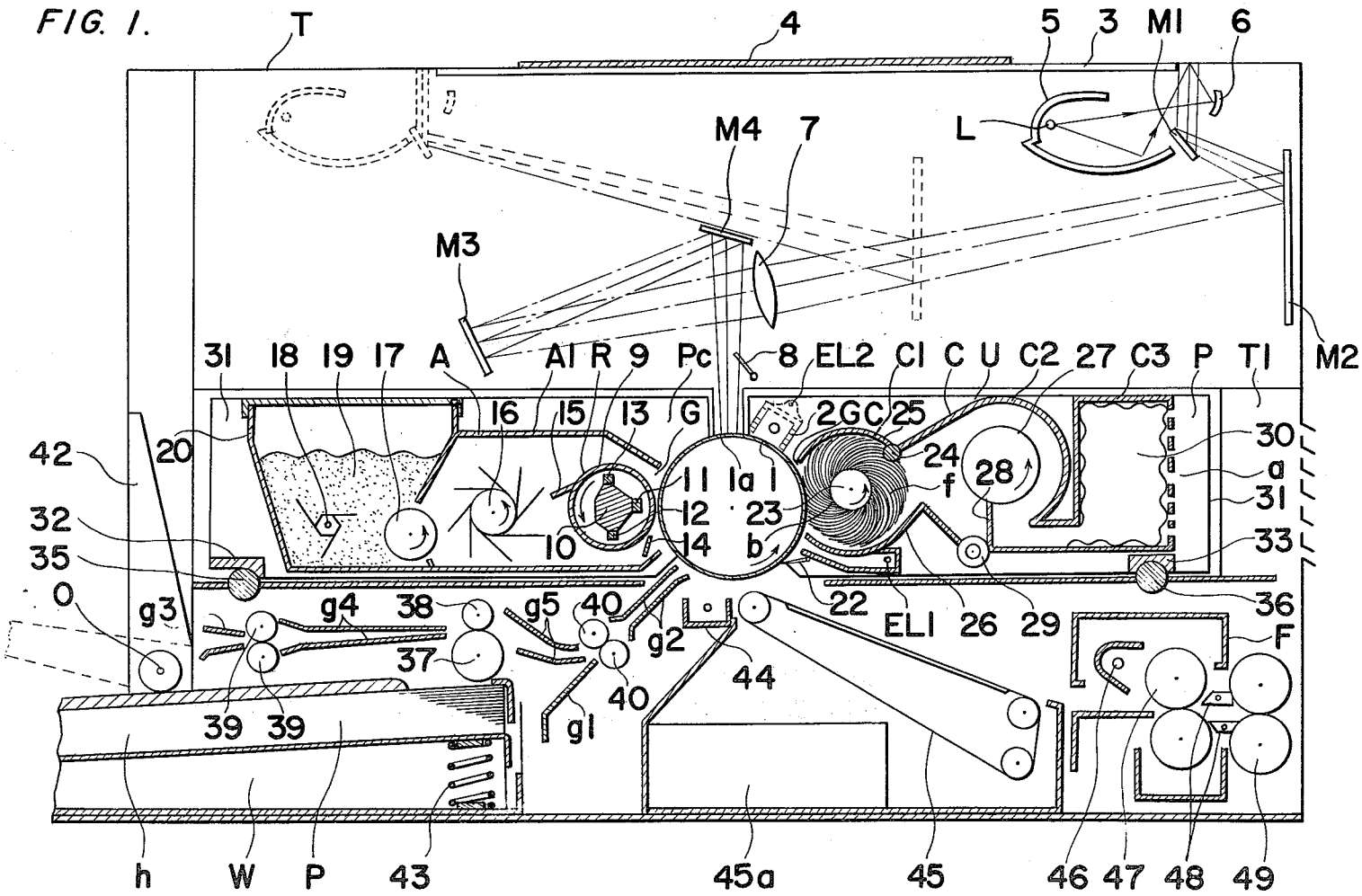

The present invention relates to a copying apparatus and, more particularly, to an electrophotographic copying apparatus employing a photoreceptor to form an electrostatic latent image of an original to be copied thereon, which latent image is subsequently developed into visible toner powder image to be transferred onto a copy paper sheet.

Conventionally, in the electrophotographic copying apparatus of the above described type, a movable photosensitive photoreceptor in the configuration of a drum or the like is widely employed, around which photoreceptor, there are sequentially disposed processing stations such as a corona charging station for imparting electrical charge on the photoreceptor surface, an exposure station for forming an electrostatic latent image of an original to be copied on the photoreceptor surface through a light source and an optical system, which exposure station is disposed between a platform to place the original thereon and the photoreceptor surface, a developing station including a developing device for developing the latent image into a visible toner powder image, a transfer station in which the toner powder image is transferred onto a copy paper sheet, a fixing device for fixing the copied paper sheet by heater means, and a residual toner removing device for removing toner particles off the photoreceptor surface.

In the conventional copying apparatus of the above described type, especially, the developing device, the residual toner removing device and the photoreceptor include expendable portions or parts having a predetermined period of life, which expendable portions must be replaced and adjusted one after anaother after a predetermined period in order to maintain uniform reproduction or copying quality. More specifically, when the photosensitive surface of the photoreceptor itself is fatigued or deteriorated by light rays, heat, electrical charge, etc., deterioration of copied images due to decline in characteristics by the adhesion of toner resin to the photosensitive surface or by scuff marks formed on the photosensitive surface, inevitably make it necessary for the photoreceptor to be replaced. In the developing device also, periodical replacement thereof is required, since deterioration in the quality of copied images is brought about by the decrease of image density or indefinite image outline due to unstable charge on the toner particles arising from adhesion of toner resin, wearing out or deterioration on the surfaces of magnetizable carrier particles for transporting toner particles. Similarly, in the residual toner removing device also, reduction of cleaning capacity due to deterioration of cleaning parts, for example, a cleaning brush made of fibrous material, a cleaning cloth in the form of web or a doctor blade made of rubber-like material, or excessive wearing out of such cleaning parts which can not be restored through mere cleaning makes it necessary for the device to be replaced.

Accordingly, in the conventional copying apparatus of the above described type, it has been arranged to releasably incorporate such photoreceptor, developing device and residual toner removing device separately in the copying apparatus for exchanging expendable parts and for adjustment of such components depending on the necessity, which arrangement, however, has various disadvantages. One of such disadvantages is that since the relative positions of the developing device, the photoreceptor and the residual toner removing device, which relative positions influence the quality of copied images, must be precisely determined, various members for accurately positioning such devices are required, thus undesirably complicating the copying apparatus itself, while another disadvantage involved is that replacement of the expendable parts and adjustments thereof require considerable time and troublesome procedures.

In order to overcome above described disadvantages, there have been proposed in recent years some conceptions to reduce maintenance frequencies through increased capacities of the developing device, the residual toner removing device and the photoreceptor, which conceptions, however, are not desirable since the same necessarily result in large size of the copying apparatus. On the other hand, the developing devices employed in the copying apparatus of the above described type are generally classified into two types, one of which is the cascade type wherein developer material comprising magnetizable carrier material and toner particles is cascaded onto the photoreceptor surface from a position above the latter for developing the latent image formed on the photoreceptor surface into the visible toner powder image, and the other of which is the magnetic brush type wherein the developing material is attracted onto the surface of a magnetic developing roller disposed adjacent to the photoreceptor surface to form magnetic brush bristles thereon for rubbing against the latent image formed surface of the photoreceptor by the brush bristles so as to develop the latent image into the visible toner powder image. In the quality of the copied images, the former device of the cascade type is not very good in the reproduction of half tone, although capable of reproducing letters, drawings etc., definitely and clearly without necessity of exposure amount adjustments in copying, while the latter device of the magnetic brush type requires exposure amount adjustments in copying, although capable of reproducing half tone of pictures or the like definitely, which advantages and disadvantages inherent in either one type of the device make it very difficult to present a developing device having combined advantages of the both types simultaneously.

Furthermore, the conventional copying apparatus of the above described type has such disadvantages that mechanisms incorporated therein for manual and automatic feeding of copy paper sheets tend to be complicated, consequently resulting in large size and high manufacturing cost of the copying apparatus itself.

Accordingly, an essential object of the present invention is to provide an electrophotographic copying apparatus wherein a photoreceptor, a developing device and a residual toner removing device are advantageously built in a casing as on unit so as to be releasably inserted into the copying apparatus housing for efficient replacement and maintenance of such components with substantial elimination of the disadvantages inherent in the conventional copying apparatuses.

Another important object of the present invention is to provide an electrophotographic copying apparatus of the above described type which is accurate in functioning and easy to operate for reproducing clear and definite copied images.

A further object of the present invention is to provide an electrophotographic copying apparatus of the above described type which is simple in construction and compact in size with consequent low manufacturing cost.

A still further object of the present invention is to provide an electrophotographic copying apparatus of the above described type in which efficient copy paper sheet feeding device of simple construction suitable for selective manual and automatic copy paper feeding are advantageously incorporated.

According to a preferred embodiment of the present invention, three major components of the copying apparatus, i.e., a photoreceptor in the configuration of a drum, a developing device and a residual toner removing device are advantageously built in a casing as one unit, which casing is releasably inserted into the housing of the copying apparatus, with a driven shaft of each of the devices extending outwardly from the rear side wall of the unit casing for engagement with corresponding driving shaft provided in the apparatus housing, by which arrangement, the casing including the component devices having expended portions or worn out parts after a predetermined period of time can be withdrawn from the apparatus housing as it is for replacement with a separately prepared fresh casing including new component devices, thus maintenance or exchange of such component devices being much simplified and efficiently carried out. Furthermore, in the copying apparatus of the present invention, by selectively inserting separately prepared casings which incorporate therein the developing device of the cascade type or that of the magnetic brush type into the apparatus housing, the copying apparatus can be very readily converted from the cascade developing type to the magnetic brush developing type or vice versa. Additionally, the replaceable unit casing for the component devices of the invention can advantageously be applied to different types of copying apparatuses, for example, to a copying apparatus with a movable platform for placing an original thereon or to a copying apparatus having a stationary platform, depending upon the requirements. Moreover, by the incorporation of copy paper feeding device which enables easy selection of manual feeding or automatic feeding, efficient copying operation can be advantageously effected through simple procedures.

Figure 2:
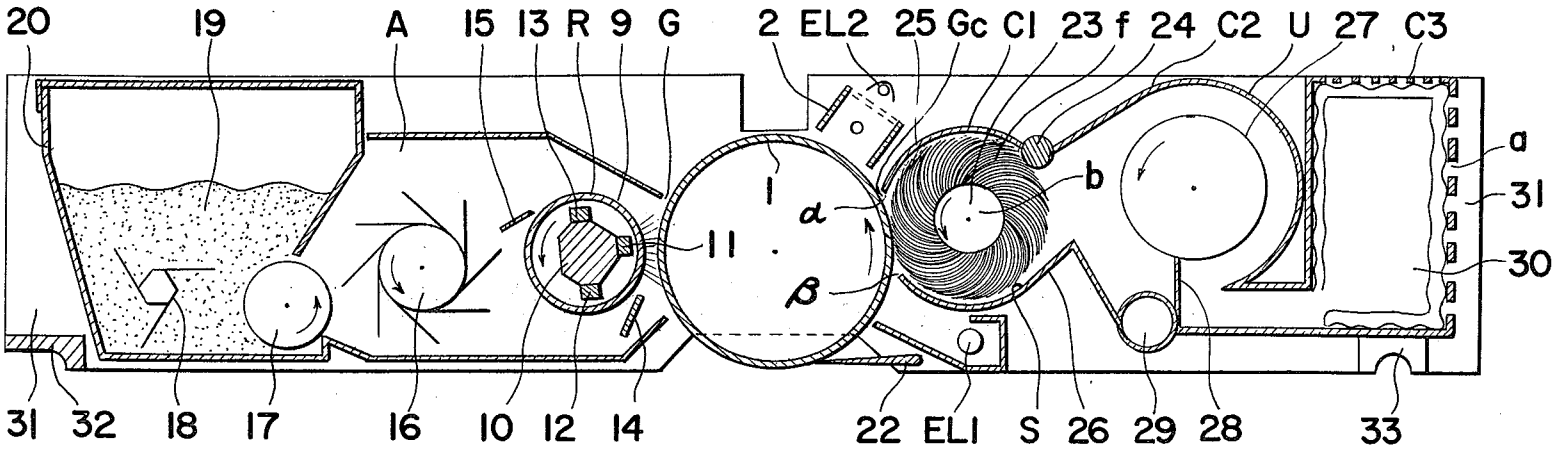
Figure 4:
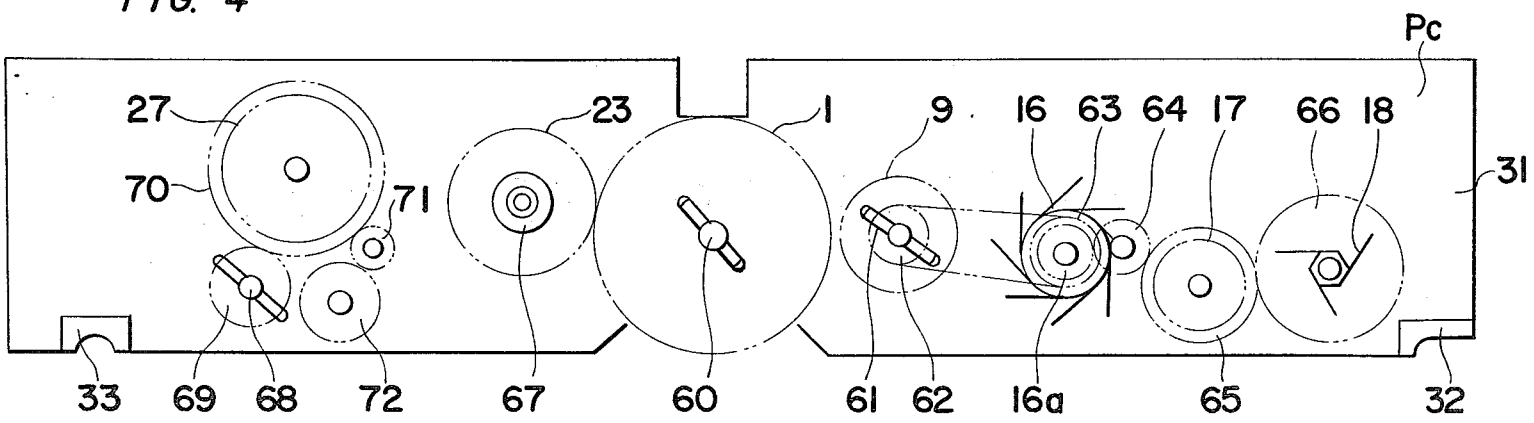
Figure 3:
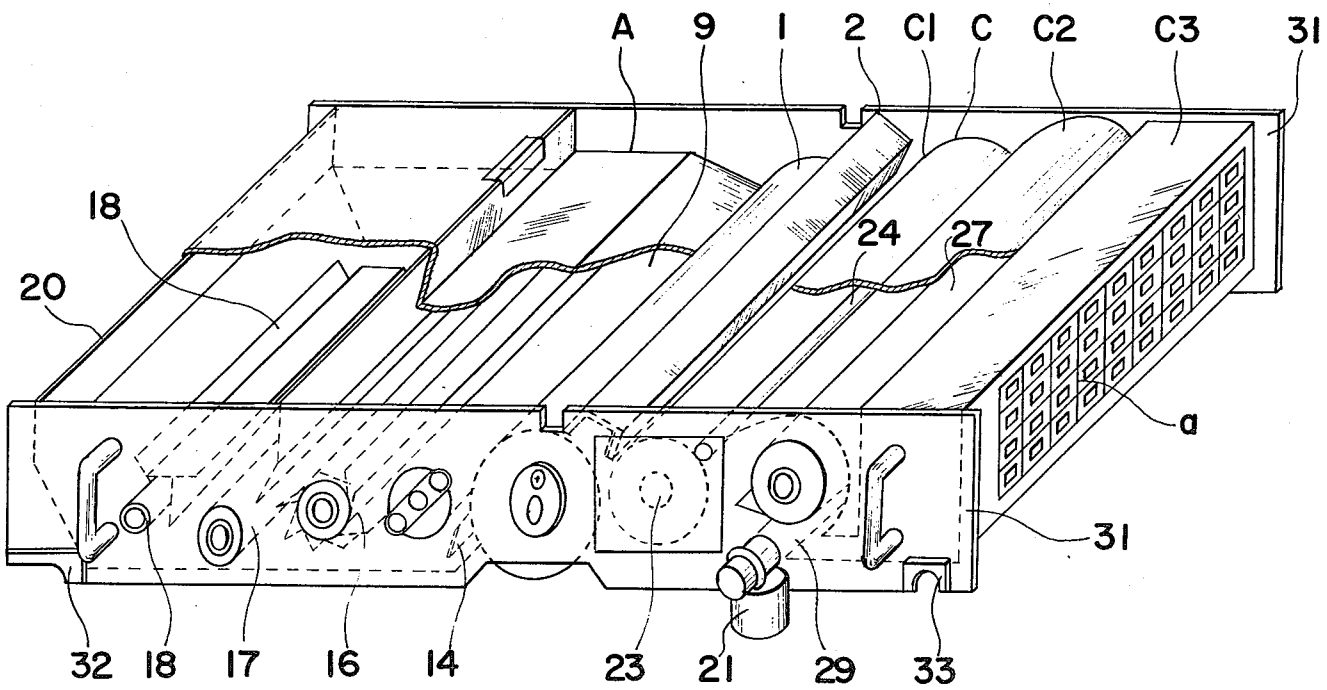
Figure 5:
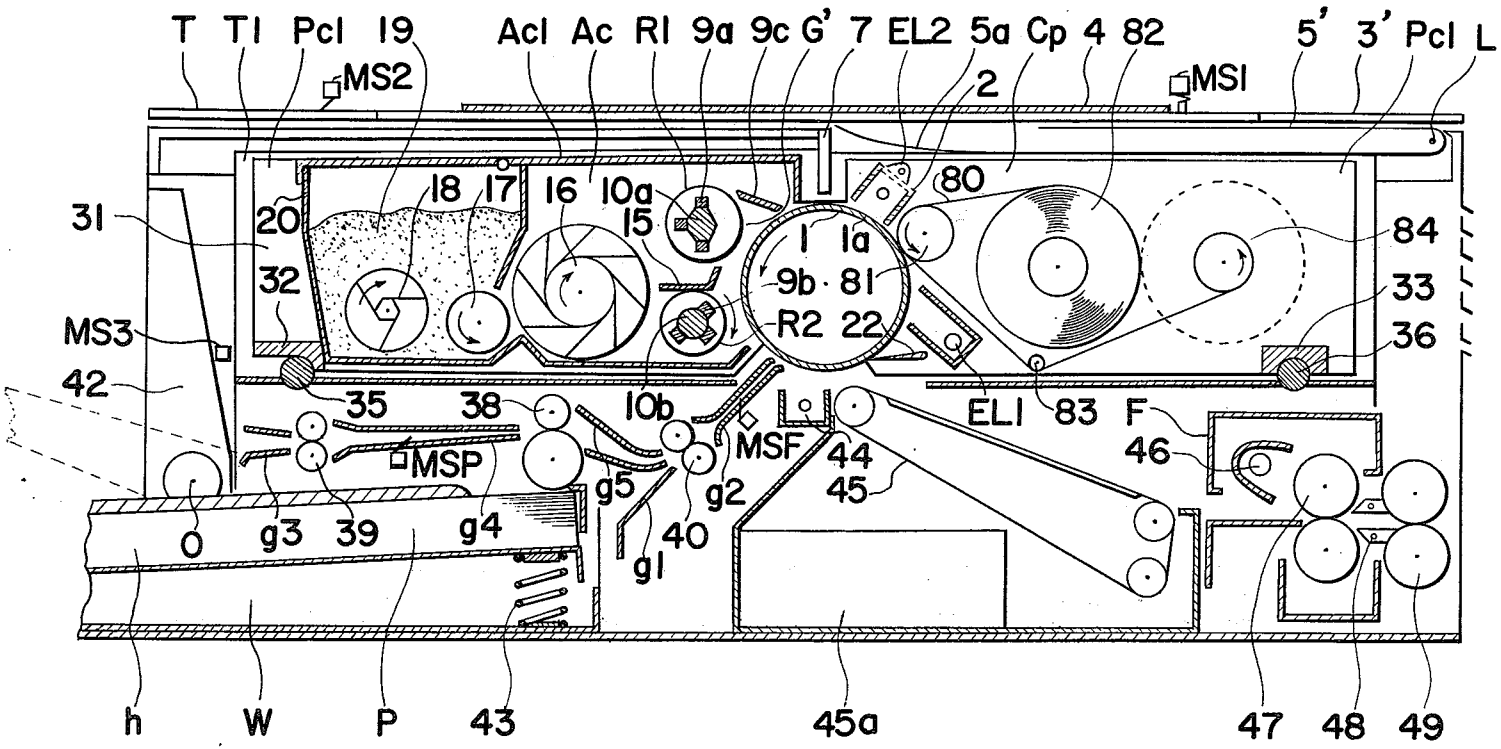
Figure 6:
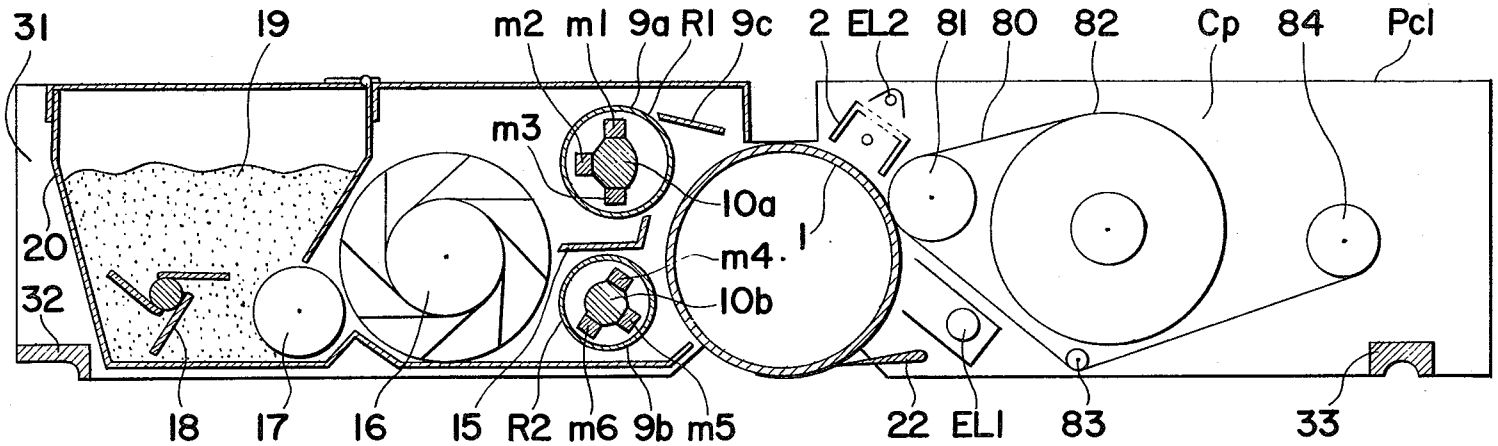
Figure 7:
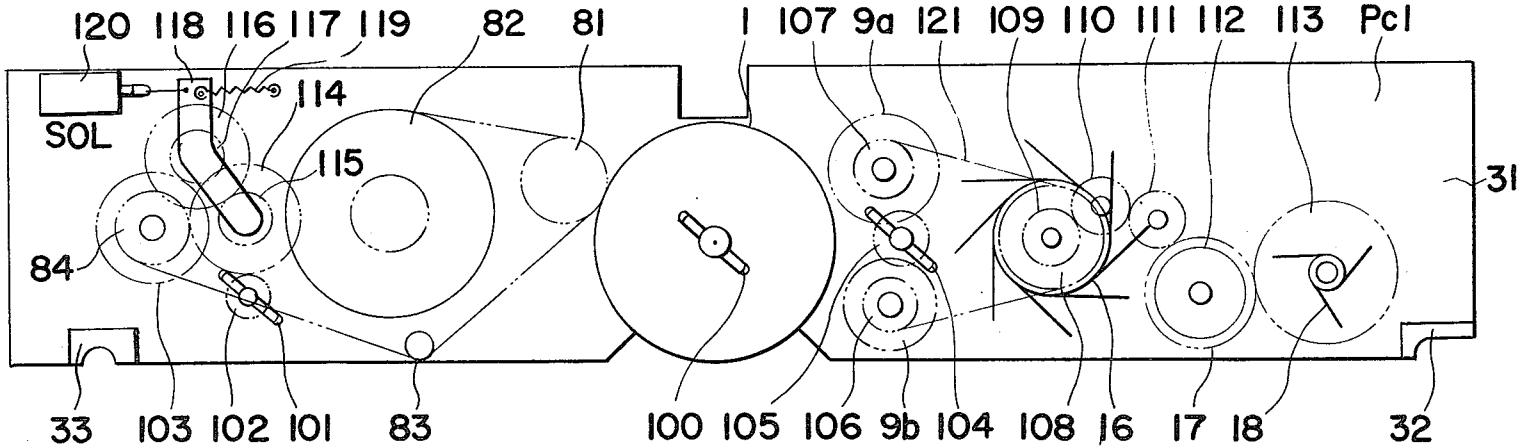
Figure 8:
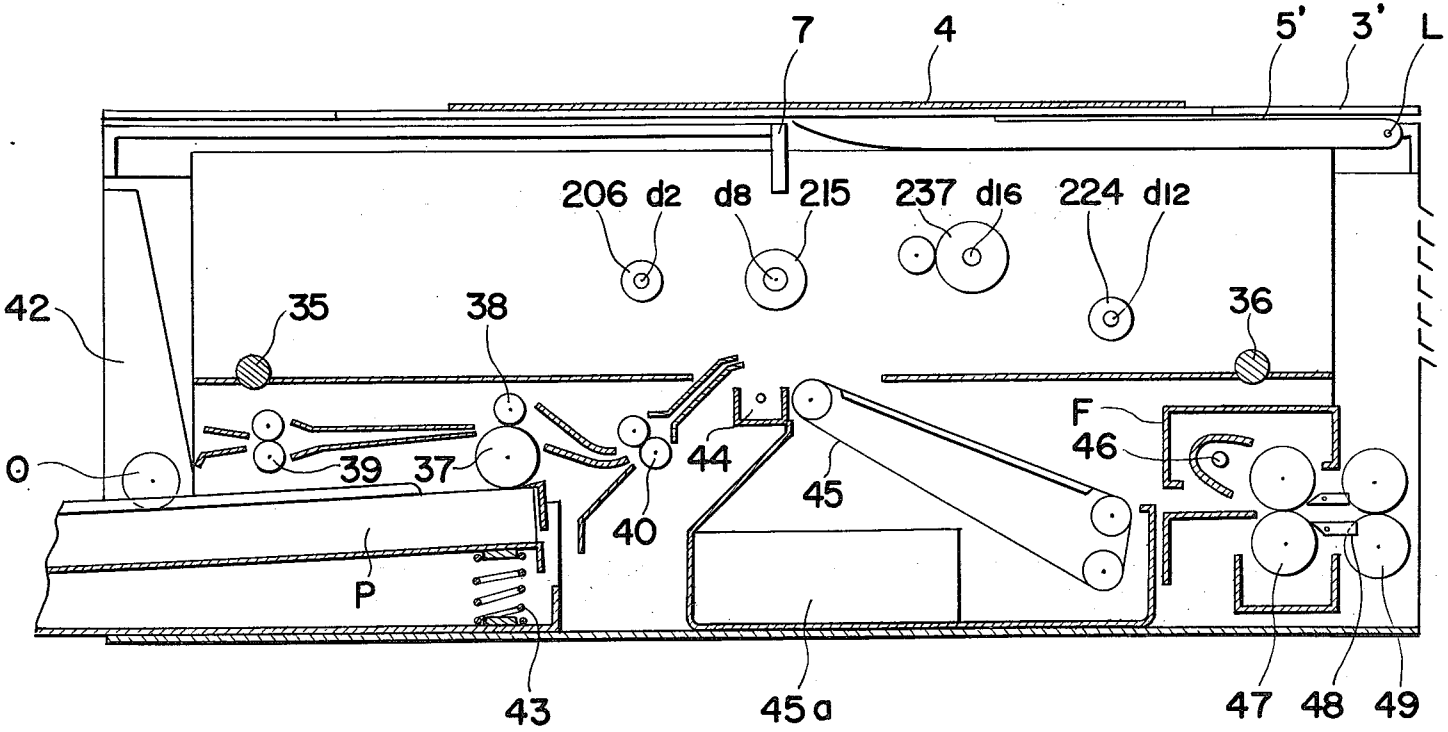
Figure 9:
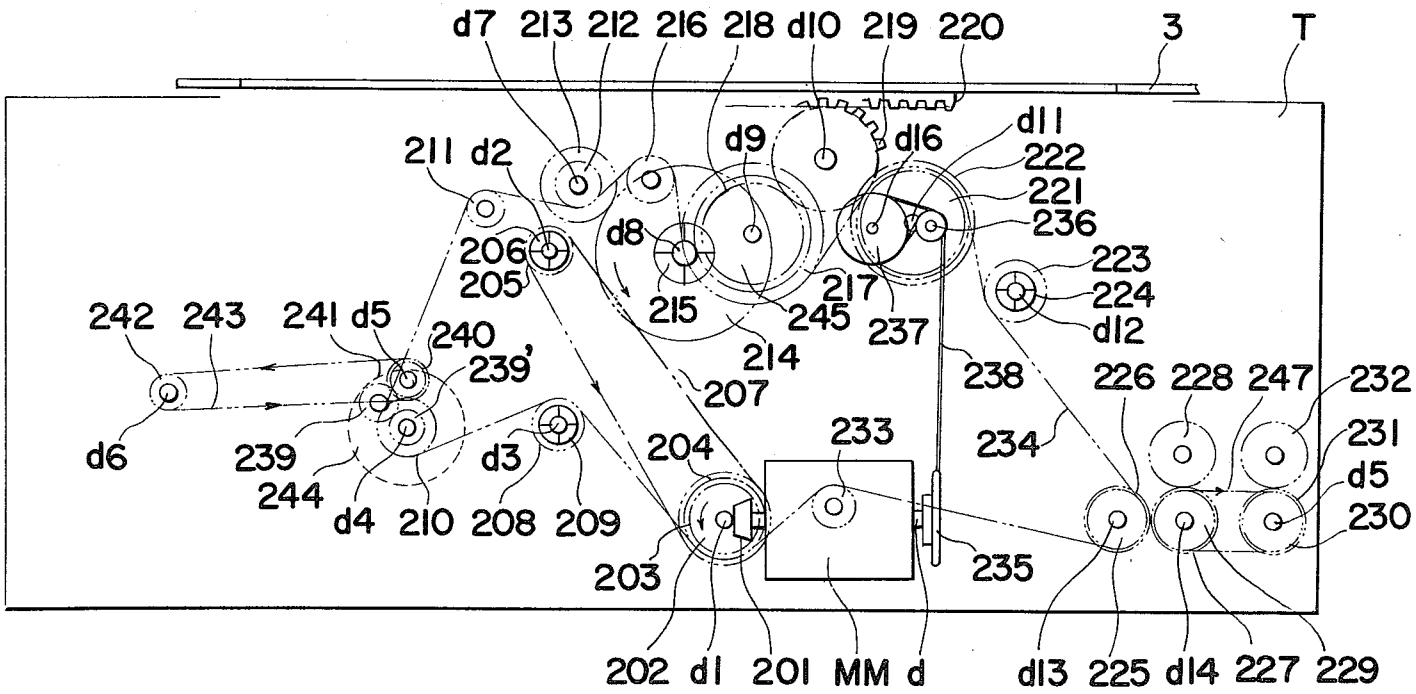
Figure 10:
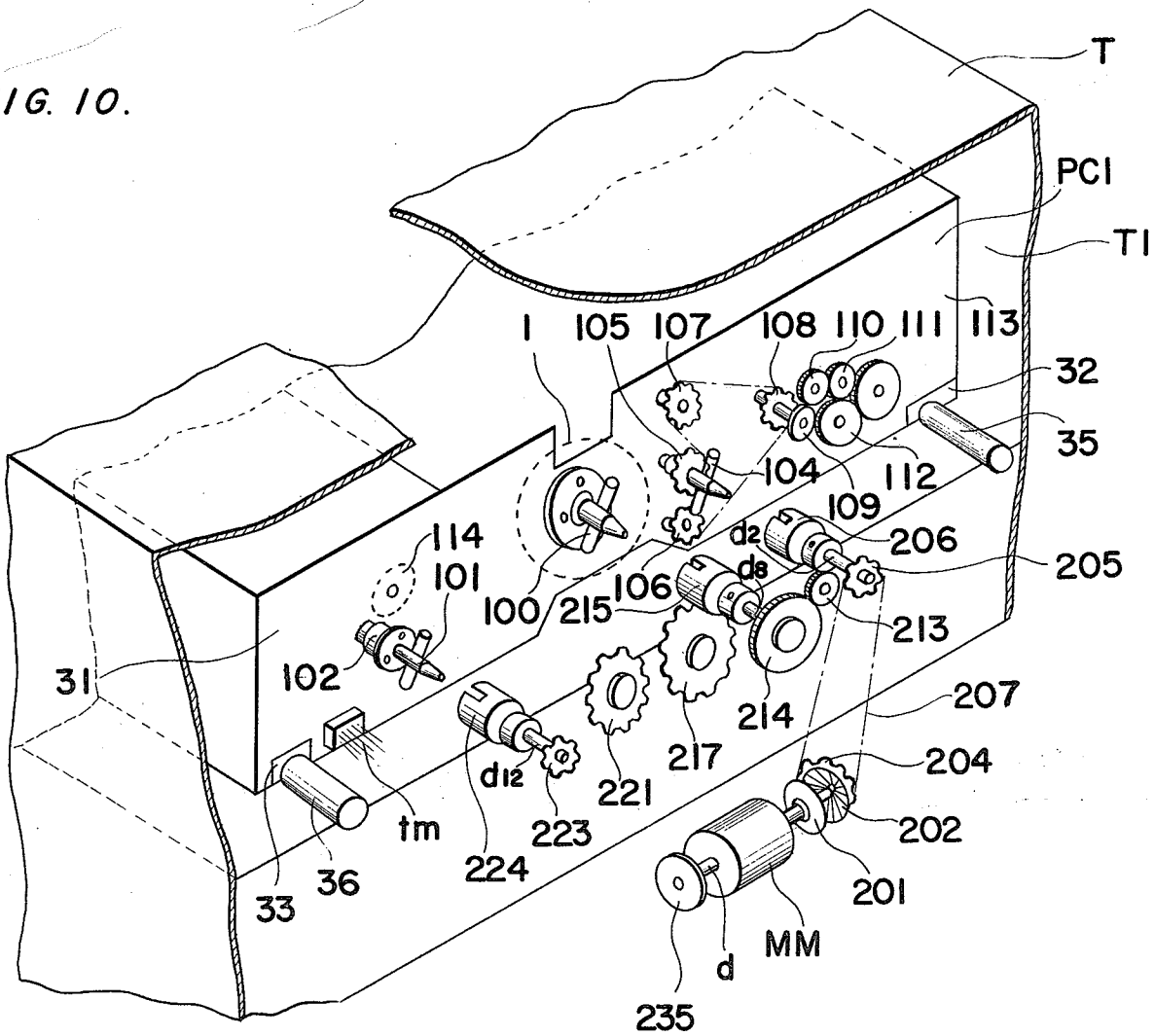
Figure 11:
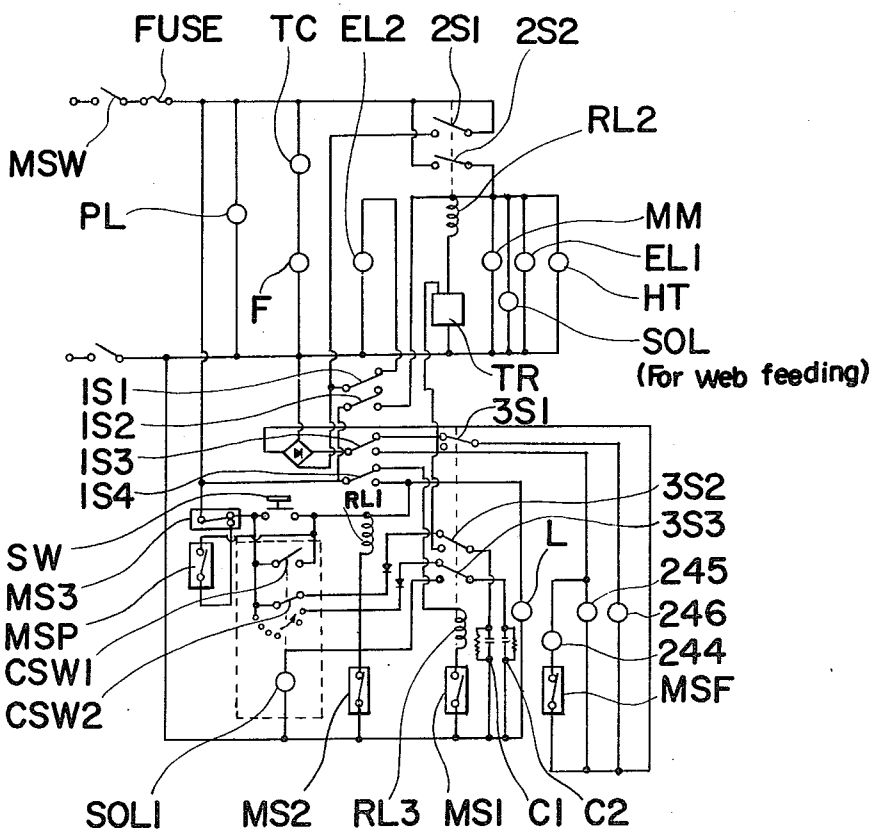
Figure 12:
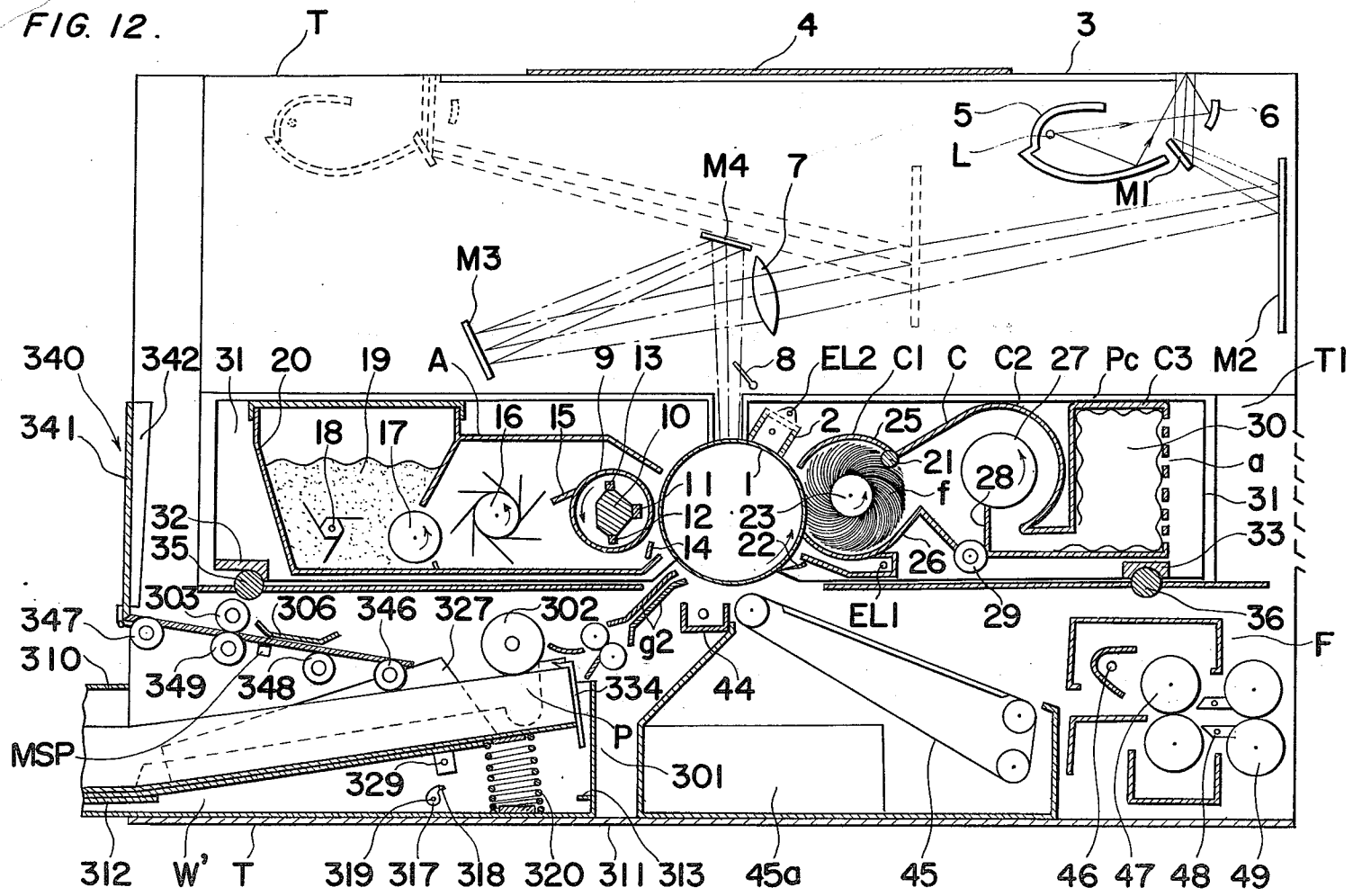
Figure 13:
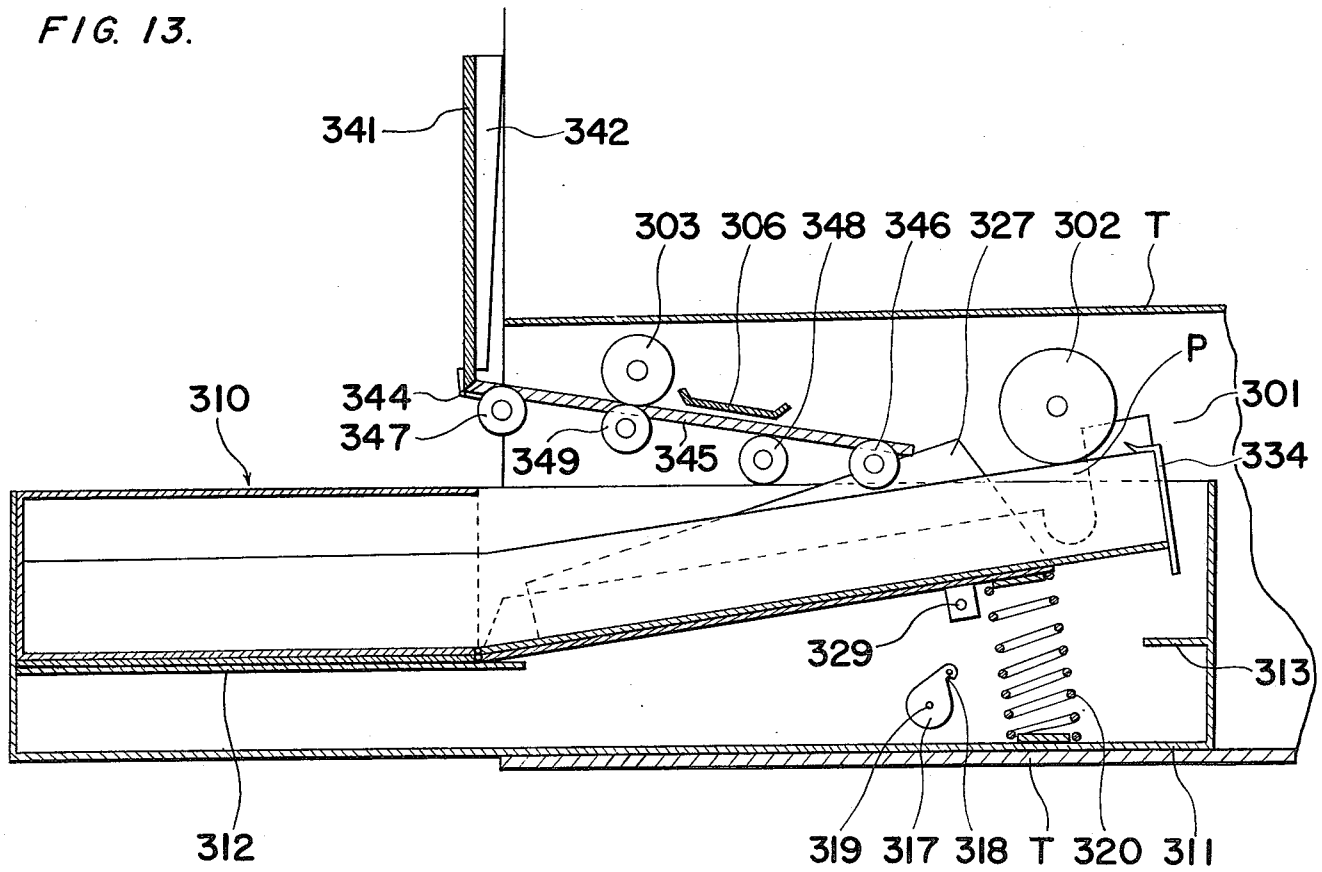
Figure 14:
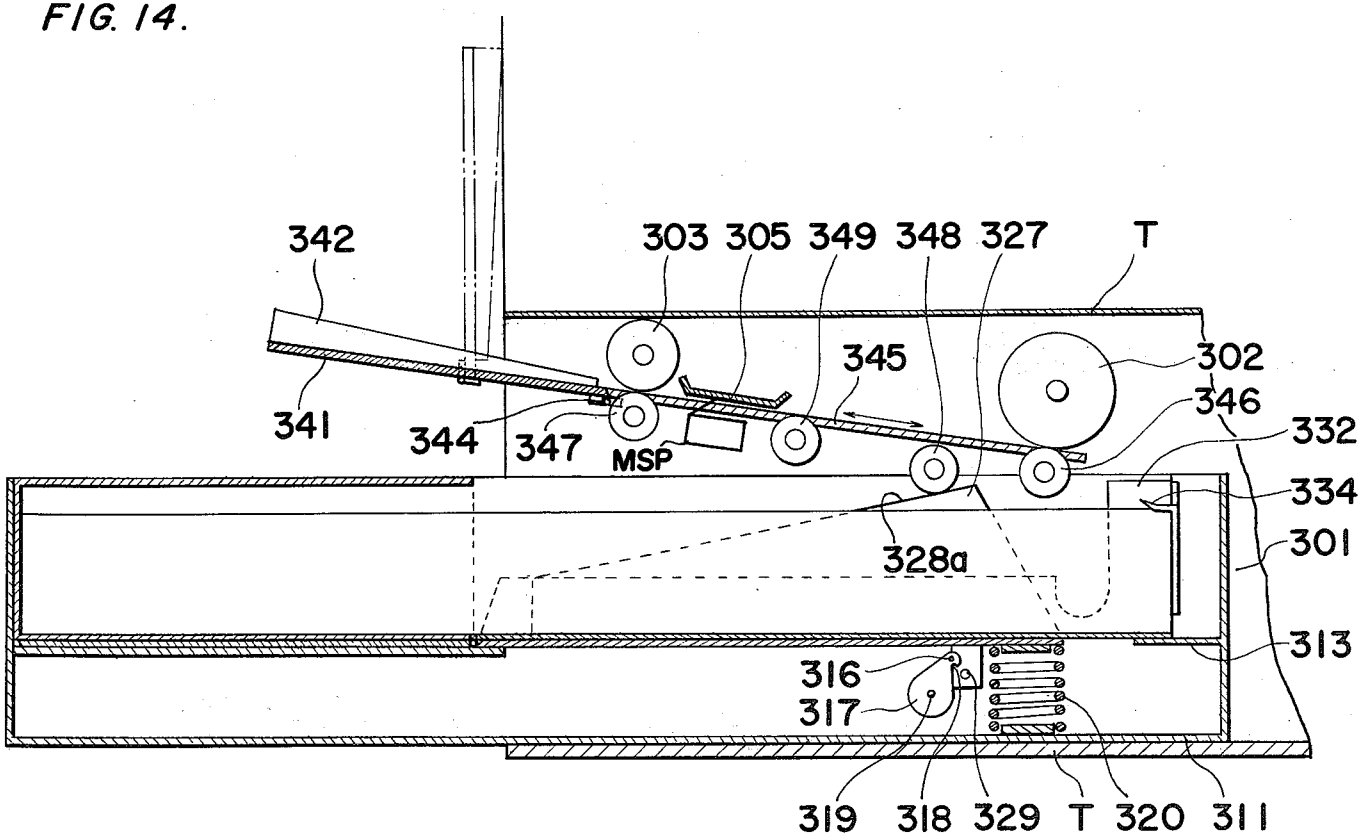
Figure 15:
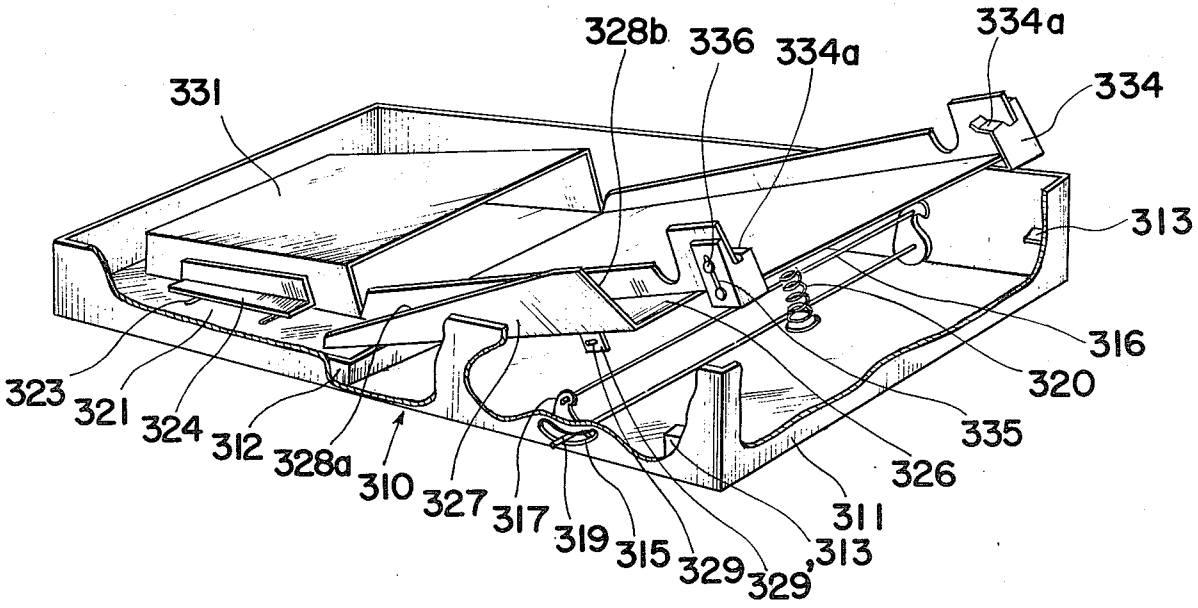
Figure 16:
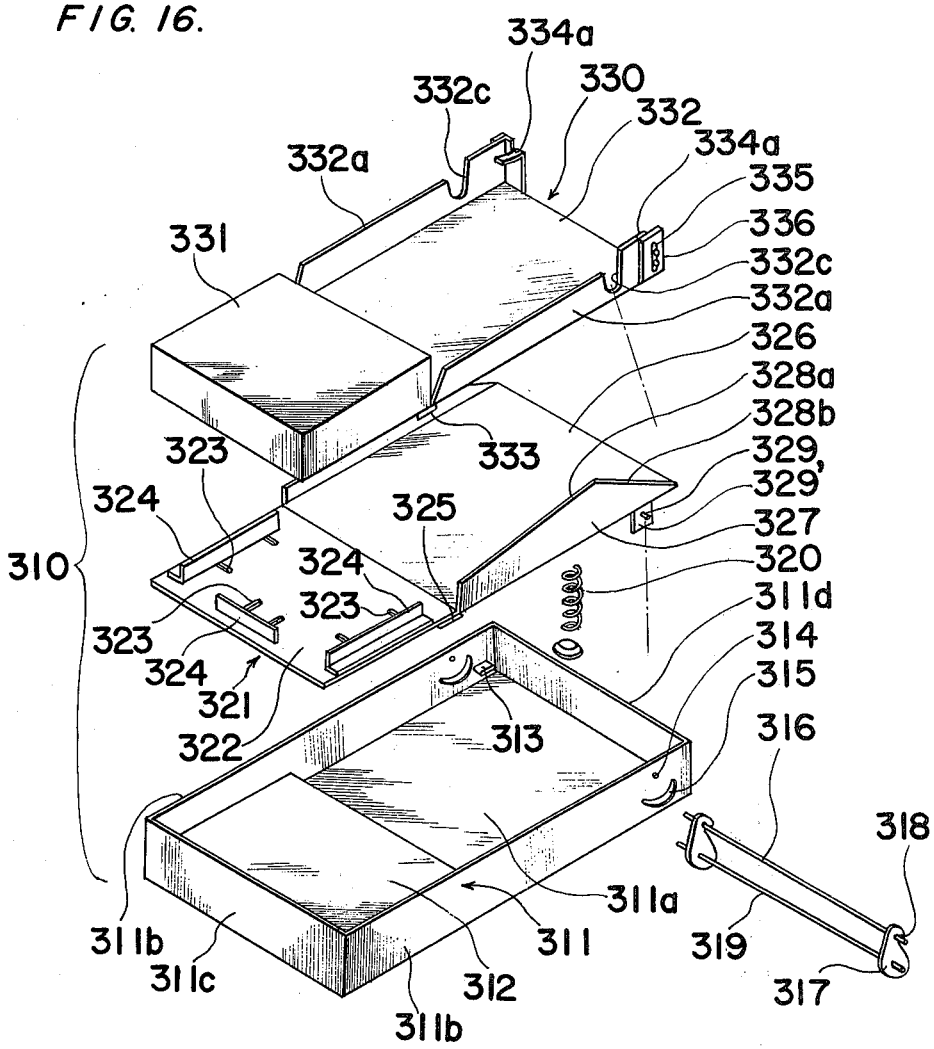
Figure 17:
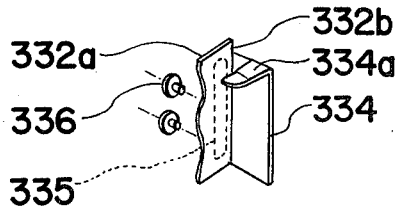
Figure 18:
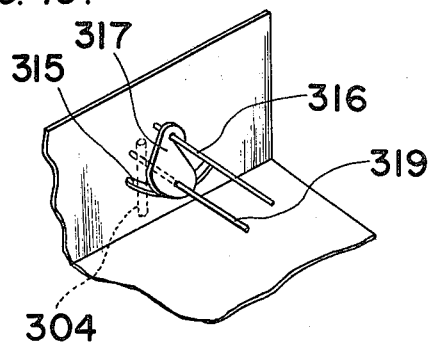
Figure 20:
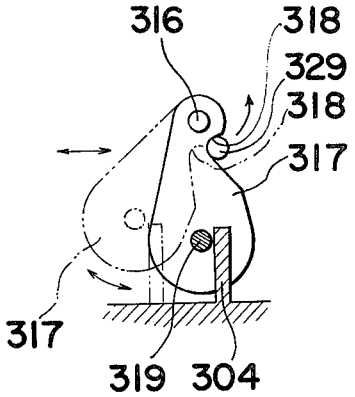
Figure 19:
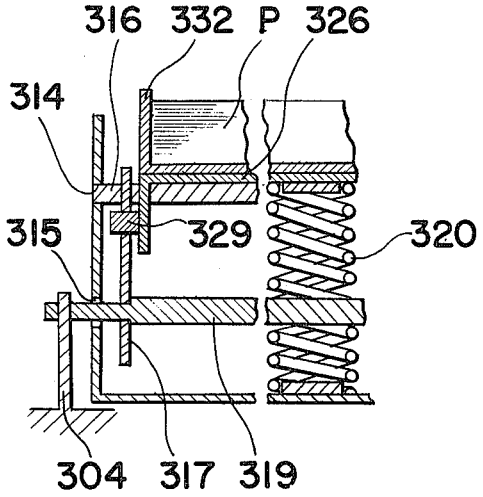
Figure 21:
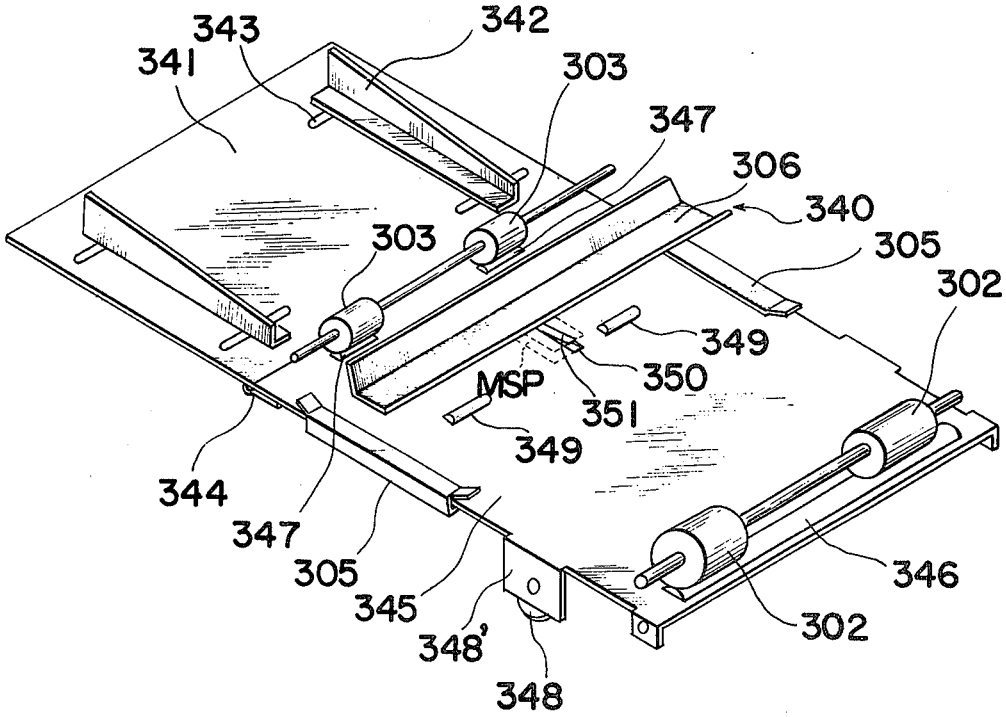

These and other objects and features of the present invention will become apparent from the following description taken in conjunction with the preferred embodiment thereof with reference to the accompanying drawings, in which;

FIG. 1 is a schematic diagram showing a sectional side view of a copying apparatus according to a preferred embodiment of the invention, FIG. 2 is a cross sectional view, on an enlarged scale, of a unit casing employed in the copying apparatus of FIG. 1, FIG. 3 is a perspective view partly broken away showing construction of the unit casing of FIG. 2, FIG. 4 is a schematic diagram showing arrangement of driven members of the unit casing of FIG. 2, FIG. 5 is a similar view to FIG. 1, but particularly shows a modification thereof, FIG. 6 is a similar view to FIG. 2, but particularly shows a modification thereof;

FIG. 7 is a schematic diagram showing arrangement of driven mechanism in the unit casing of FIG. 6, FIG. 8 is a similar view to FIG. 1, but particularly shows arrangement of driving members thereof with the unit casing removed, FIG. 9 is a similar view to FIG. 1, but particularly shows internal driving mechanism thereof associated with the driving members, FIG. 10 is a perspective view, partly broken away, showing connection between the driven members of the casing unit and the driving members provided in the apparatus housing, FIG. 11 is an electrical circuit diagram illustrating connections of various elements of the copying apparatus according to the present invention, FIG. 12 is similar view to FIG. 1, but particularly shows a modification thereof in the sheet feed device, FIG. 13 is a sectional side view of the sheet feed device incorporated in the copying apparatus of FIG. 12 with an automatic sheet feed portion of said device in operative position, FIG. 14 is a similar view to FIG. 13 but particularly shows a manual sheet insertion portion of the sheet feed device in operative position, FIG. 15 is a perspective view partly broken away of an automatic sheet feed casing employed in the copying apparatus of FIG. 12, FIG. 16 is a schematic disassembly view of the automatic sheet feed casing of FIG. 15, FIG. 17 is a perspective view showing, on an enlarged scale, construction of a sheet feed claw employed in the automatic sheet feed casing of FIG. 15, FIG. 18 is a perspective view showing on an enlarged scale function of a stopper plate employed in the casing of FIG. 15, FIG. 19 is a cross sectional view showing on an enlarged scale the stopper plate and associated mechanisms employed in the casing of FIG. 15, FIG. 20 is a side elevational view, on an enlarged scale, explanatory of the function of the stopper plate employed in the casing of FIG. 15, and FIG. 21 is a perspective view showing on an enlarged scale construction of a manual sheet feeding portion of the sheet feed device of FIG. 14.

Before the description of the present invention proceeds, it is to be noted that like parts are designated by like numerals throughout several views of the accompanying drawings.

Referring to FIG. 1, there is shown an electrophotographic copying apparatus according to the present invention which mainly comprises a housing T thereof, a stationary transparent platform 3 horizontally supported at the upper portion of the housing T for placing on original 4 to be copied thereon, a main light source L enclosed in a curved mirror 5 and movably supported below and adjacent to the platform 3 for reciprocating in a direction parallel to the under surface of the platform 3 so as to illuminate the original 4, an optical mirror and lens system movable together with the light source L for projecting light rays from the original 4 onto the surface of a photoreceptor 1, an exchangeable unit P of a rectangular box-like shape which is slidably and releasably received in a receptacle portion $T_1$ of similar shape formed in approximately a central portion of the housing T below the platform 3, which unit P further comprises front and rear walls 31 with the photoreceptor 1, a developing device A and a residual toner removing device C integrally disposed therebetween in a manner described later so as to define a unit casing Pc, a sheet feed device W disposed below the unit casing Pc at the lower left-hand portion of the housing T, a transfer charger 44 provided below and adjacent to the photoreceptor drum 1 for transferring the visible toner image formed on the photoreceptor surface 1a onto a copy paper sheet and a fixing device F also disposed below the unit casing Pc at the lower right-hand portion of the housing T of FIG. 1 for fixing the transferred image on the copy paper sheet.

In the unit casing Pc, the photoreceptor 1 in the drum configuration having diameter approximately equal to or shorter than the height of the front or rear wall of the unit casing Pc is rotatably supported by a shaft suitably journaled in the front and rear walls at the central portion of the casing Pc, while the developing device A of magnetic brush type is disposed adjacent to and at the left of the photoreceptor drum 1 with the residual toner removing device C provided close to the drum 1 at the right portion of the casing Pc in FIG. 1.

The unit casing Pc is provided, at the opposite lower end portions thereof, with metallic positioning members 32 and 33, which members 32 and 33 slidably engage corresponding sliding shafts 35 and 36 disposed at opposite lower end portions of the receptacle portion $T_1$ of the apparatus housing T.

The photoreceptor drum 1 further comprises a cylindrical supporting member of metal such as aluminum or stainless steel, or a similar supporting member of plastics or the like with comparatively small diameter (60 to 100 mm) having a thin outer layer of aluminum, chromium, nickel etc., vacuum-deposited or electroplated on the outer periphery of the supporting member, on which outerlayer, a thin electrophotoconductive layer of amorphous Se alloy containing, for example, 10 to 30% by weight of Te or 10 to 30% by weight of As, or of three composition alloy containing Se, Te and As is further vacuum-deposited to a thickness less than 1 $\mu$, preferably to a thickness of approximately 0.5 $\mu$ with organic semiconductor such as PVK in the liquid form being further applied thereto to form an endless film layer of 10 to 30 $\mu$, preferably of approximately 20 $\mu$ thick in dried state thereon. Alternatively, such an electrophotoconductive layer may be formed with a single layer of amorphous Se alloy.

It should be noted here that, although in the embodiment of FIG. 1 it is intended to provide a copying apparatus of compact size through employment of the photoreceptor drum of small diameter, the photoreceptor drum is not limited to the type described above from the scope of the present invention, but may be of any conventional types.

Still referring to FIG. 1, there is provided a corona charger 2 adjacent to the upper right portion of the photoreceptor drum 1, which corona charger 2 is adapted to effect corona discharge having polarity suitable for the charging characteristics of the electrophotoconductive layer of the photoreceptor drum 1 so as to sequentially charge the suruface 1*a* of the drum 1 as the drum 1 rotates. The upper surface of the casing of the corona charger 2 is formed into wire mesh, behind which wire mesh, an eraser lamp EL2 is disposed for erasing unnecessary charge remaining on the photoreceptor drum 1.

The light rays from the original 4 illuminated directly or through the curved mirror 5 and a reflecting mirror 6 by the light source L movably disposed below the platform 3 are directed to a mirror M1 disposed below the platform 3 in a direction normal to the under surface of the platform 3. The mirror M2 in turn directs, through a lens 7, the image rays to a mirror M3 and then to a mirror M4, which mirrors M3 and M4 are fixedly disposed between the platform 3 and the photoreceptor drum 1 and suitably inclined for directing the light rays onto the photo-sensitive surface 1*a* of the photoreceptor drum 1 through an exposure amount adjusting plate 8 pivotally disposed above the drum 1, thus electrostatic latent image of the original 4 being formed on the photosensitive surface 1*a* of the photoreceptor drum 1.

As the drum 1 rotates, the latent image formed portion of the photosensitive surface 1*a* reaches the developing device A, whereat the latent image is developed into a visible toner powder image. The developing device A incorporated at the left portion of the unit casing Pc adjacent to the drum 1 in FIG. 1 extends across the width of the photoreceptor surface 1*a* and is enclosed in a housing A1 which has an opening G adjacent to the photoreceptor surface 1*a* and is also communicated with a toner dispenser 20 incorporated in the left portion of the casing Pc, and in which developing material comprising magnetizable carrier material such as iron particles and electroscopic toner powder, for example, of resin-treated carbon black charged with polarity suitable for developing is accommodated. At the right portion of the housing A1 adjacent to the opening G, a magnetic roller R is rotatably disposed, which magnetic roller R further comprises an outer cylinder 9 of non-magnetic material such as aluminum or brass having, for example, minute undulation on the outer periphery thereof for increasing friction and suitably supported for rotation between the front and rear walls 31 of the unit casing Pc, and three stationary bar magnets 11, 12 and 13 enclosed in the outer cylinder 9. The bar magnets 11, 12 and 13 are spaced from each other at an angle of approximately 90° and fixedly mounted on a bar 10 suitably secured to the front and rear walls 31 of the casing Pc, with the magnetic pole of the magnet 11 specially directed toward the axis of the photoreceptor drum 1.

As the outer cylinder 9 rotates, the developing material accommodated in the housing A1 is attracted onto the surface of the cylinder 9 by the magnetic force of the magnet 12 so as to form magnetic brush bristles on the cylinder surface at the position of the magnet 11, which brush bristles rub lightly against the latent image formed surface 1*a* of the rotating drum 1 for developing the latent image into a visible toner powder image. An adjusting plate 14 is disposed at the lower portion of and adjacent to the cylinder 9 for adjusting the length of the brush bristles to be formed. The developing material thus used for the developing is further attracted by the magnet 13 and carried by the cylinder 9 as the same rotates in the direction of an arrow so as to be scraped off the cylinder 9 by a scraper plate 15 disposed, at the upper left portion of the cylinder 9, in contact with the surface of the cylinder 9.

Toner powder 19 stored in the toner dispenser 20 is stirred by a stirrer vane 18 and simultaneously scraped up by the carrier particles which are attracted onto the surface of a toner supplying magnetic roller 17 rotatably disposed adjacent to an opening formed between the developer housing A1 and the toner dispenser 20. The toner particles thus attracted onto the roller 17 are then fed into the developer housing A1 as the roller 17 rotates and subsequently stirred and mixed efficiently with the developing material scraped off the outer cylinder 9 through rotation of a stirrer vane 16 for the developing material, by which arrangement toner concentration in the used developing material is restored to be maintained at a constant level for subsequent development.

The photoreceptor surface 1*a* of the drum 1 bearing the visible toner powder image thereon developed by the developing device A reaches the transfer station as the drum 1 rotates for transferring the toner powder image onto a transfer material or a copy paper sheet fed thereto in a manner described below.

In the sheet feed device W disposed at the left lower portion of the apparatus housing T, cut sheets P of transfer material, for example, copy paper held on a tray or casing *h* and urged toward a separator roller 37 through a compression spring 43 are fed, one sheet by one sheet, to the transfer station through the roller 37, a guide plate *g*1, a pair of feed rollers 40 and a pair of guide plates *g*2. By turning a manual insertion table 43, which is pivotally connected to a shaft O fixed to frames of the apparatus housing T to a position shown by a dotted line in FIG. 1, with simultaneous releasing of urging of the cut sheets P in the casing *h* toward the separator roller 37 through a mechanism not shown, manual insertion of copy paper sheets is made possible through a pair of guide plates *g*3, feed rollers 39 for manual insertion, a pair of guide plates *g*4, a feed roller 38 contacting the separator roller 37, guide plates *g*5 and the pair of feed rollers 40.

The copy paper sheet fed to the transfer station in the manner as described above is closely attracted onto the photoreceptor surface 1*a* of the photoreceptor drum 1, with the toner powder image formed on the surface 1*a* being transferred onto the copy paper sheet by the transfer charger 44 which is disposed below the drum 1, in which case, the charge to be imparted by the charger 44 is of opposite polarity to the toner particles for efficient transfer of the toner powder image onto the copy paper sheet.

The copy paper sheet onto which the toner powder image is transferred in the above described manner is separated from the surface 1*a* by a separating plate 22 which is provided, at the lower right portion of the unit casing Pc, in sliding contact with the photoreceptor surface 1*a*, and is subsequently fed into the fixing device F provided with a fixing heater 46, through a conveyor belt 45 having a suction fan 45*a* and movably supported by a plurality of rollers, in which fixing device F, the transferred image is fixed on the copy paper sheet, and the copied paper sheet is subsequently discharged out of the copying apparatus onto a tray (not shown) through a pair of heat rollers 47, separating pieces 48 and a pair of discharge rollers 49.

After separation of the copy paper sheet in the above described manner, the photoreceptor surface 1*a* still having residual toner particles thereon is further discharged by an eraser lamp EL1 disposed adjacent to the lower right portion of the surface 1*a*, in a position subsequent to the separating plate 22 and reaches, as the drum 1 rotates, to the residual toner removing device C which is incorporated in the unit casing Pc adjacent to the photoreceptor drum 1.

The residual toner removing device C generally comprises a cleaning section C1, a duct section C2 and a filter section C3 which are in communication with each other. The cleaning section C, further includes a convex upper casing plate 25 having arcuate cross section and a concave lower casing plate 26 having similar arcuate cross section which is in integral connection with the bottom plate of the duct section C2 with front edges of the casing plates 25 and 26 spaced away from the photoreceptor surface 1*a* to a slight extent as at $\alpha$ and $\beta$ in FIG. 2 and defining an opening Gc adjacent to the surface 1*a*. In the space defined by the casing plates 25 and 26 facing each other, a cleaner brush *b* made of a rod 23 which is rotatably supported by the walls 31 of the unit casing Pc and which has brush bristles *f* of animal fur such as rabbit fur or synthetic fur secured on the entire outer surface thereof is housed. The brush bristles *f* are adapted to be in sliding contact with the upper casing plate 25 during rotation of the cleaner brush *b*, while the former are spaced away from the lower casing plate 26 to a predetermined degree for forming a suction passage S (FIG. 2) therebetween as the cleaner brush *b* rotates. A flicker rod 24, which extends the width of the cleaner section C1 and fixedly supported by the front and rear walls 31 of the unit casing Pc, is disposed in a path of the brush bristles *f* at a junction of the upper casing plate 25 and an upper plate U of the duct section C2 so as to contact the bristles *f* during rotation of the brush *b*. In the approximately central portion of the duct section C2 defined by the upper plate U of semicircular cross section, a bottom plate which is in integral connection with the lower casing plate 26 and the front and rear walls of the unit casing Pc, there is rotatably provided a toner collecting roller 27 composed of a rotatable electrode sleeve. A scraping plate 28 extends at right angles from the surface of the bottom plate of the duct section C2 with an upper edge of the plate 28 being in sliding contact with the surface of the toner collecting roller 27. Adjacent to the lower portion of the plate 28, a roller 29 formed with a spiral groove thereon is rotatably provided for transporting toner particles scraped off the collecting roller 27 by the plate 28 into a toner collecting bottle 21 (FIG. 3). In the filter section C3 of a box-like configuration which is communicated, at the lower portion thereof, with the duct section C2, a filter bag 30 is housed for filtering toner particles contained in an exhaust air in a manner described below.

When the photoreceptor surface 1*a* bearing the residual toner particles thereon reaches the residual toner removing device C as the drum 1 rotates in the direction shown by the arrow, the brush bristles *f* of the cleaner brush *b* wipes the residual toner particles off the photoreceptor surface 1*a* through the rotation of the brush *b* in the direction of the arrow, while the cleaner brush functioning as a blower sucks air into the cleaner section C1 through the gap $\beta$ between the photoreceptor surface 1*a* and the front edge of the lower casing plate 26, subsequently causing the air to flow through the suction passage S formed between the brush bristles *f* and the lower casing plate 26. On the other hand, the brush bristles *f* containing toner particles therein strike against the flicker rod 24 as the cleaner brush *b* rotates, with the toner particles being dislodged from the brush bristles *f*, in which case, the toner particles thus dislodged are carried by the air flow moving in the direction of an arrow so as to be attracted onto the surface of the toner collecting roller 27 and subsequently scraped off the roller 27 by the plate 28 as the roller 27 rotates in the direction shown by an arrow, the toner particles thus scraped off the roller 27 falling onto the spirally grooved roller 29 which transports the former into the toner collecting bottle 21. The air flow from which the toner particles are removed in the above described manner reaches the filter section C3 and discharged out of the casing Pc through the filter bag 30 and the openings a formed in the side wall at the left of the casing Pc in FIGS. 2 and 3.

Referring now to FIGS. 4 and 8, driving mechanism for the above unit casing Pc provided with the magnetic brush developing device A is described hereinbelow. It should be noted here that FIG. 4 shows the casing Pc as seen facing the rear wall 31 thereof for better understanding of the arrangement of various parts of the driving mechanism. Extending through the rear wall 31 of the casing Pc, there are rotatably provided a photoreceptor drum driven shaft 60, a developing device driven shaft 61, a residual toner removing device driven shaft 68 and a cleaner brush driven roller 67, with a pin fixedly mounted at the central portion thereof to the extreme end of each of the corresponding shafts 60, 61 and 68 in a direction normal to the axis of the latter.

On the other hand, extending through the innermost wall of the receptacle portion T1 of the apparatus housing T, there are rotatably provided a photoreceptor drum driving shaft *d*8, a developing device driving shaft *d*2, a residual toner removing device driving shaft *d*12, each having a connecting member 215, 206 or 224 at the end thereof, and a cleaner brush driving pulley 237 mounted on a shaft *d*16, in positions corresponding to and engageable with the driven shafts 60, 61, 68 and the driven roller 67 of the casing unit Pc for driving the latter shafts 60, 61, 68 and the roller 67 through driving means (not shown).

Accordingly, rotational force transmitted to the driven shaft 60, 61, 68 and the roller 67 drives the photoreceptor drum 1 secured to the shaft 60, the outer cylinder 9 of the developing device A and also a sprocket 62 fixedly mounted on the same shaft 61, which sprocket 62 is in turn connected to a sprocket 63 fixed on a shaft of the developing material stirring vane 16 through a chain directed around the sprockets 62 and 63 for rotating the vane 16, the gear 69 fixedly mounted on the shaft 68 which gear 69 engages a gear 70 secured to a shaft of the toner collecting roller 27 for rotating the roller 27, and the cleaner brush 23 connected to the roller 67, while a gear 16*a* fixedly mounted on the same shaft as the sprocket 63 engages, through an intermediate gear 64, a gear 65 secured to a shaft of the toner supplying magnetic roller 17 which gear 65 further meshes with a gear 66 secured to a shaft of the toner powder stirrer vane 18 for rotating the vane 18. The gear 70 secured to the shaft of the toner collecting roller 27 further engages, through an intermediate gear 71, a gear 72 fixedly mounted on a shaft of the spirally grooved roller 29 for toner powder transportation to rotate the roller 29.

Electrical power for energizing the corona charger 2 and eraser lamps EL1 and EL2 incorporated in the casing Pc is supplied to the casing Pc through connection of a socket and a plug (not shown) suitably provided in the casing Pc and the apparatus housing T.

Referring now to FIG. 5, there is shown a modification of the copying apparatus of FIG. 1. In this modification, the magnetic brush type developing device A and the residual toner removing device C of cleaner brush type described as incorporated in the unit casing Pc of FIG. 1 are replaced by a cascade type developing device Ac and a cleaner device Cp of paper web type which are similarly incorporated in a unit casing Pc1, while the optical mirror and lens system including the exposure amount adjusting plate 8 described as employed in the embodiment of FIG. 1 is also replaced by a known image transmitter 7 formed by a bundle of optical fibers as disclosed in the U.S. Pat. No. 3,658,407, patented on Apr. 25, 1972, to which reference may be made for details thereof.

In the casing unit Pc1, the developing device Ac of the cascade type is disclosed adjacent to and at the left of the photoreceptor drum 1 while the cleaner device Cp of paper web type provided close to and at the right of the drum 1 between the front and rear walls 31 of the casing Pc1 with the casing Pc1 provided, at the opposite lower portions thereof, with the metallic positioning members 32 and 33 which members 32 and 33 are adapted to slidably engage corresponding sliding shafts 35 and 36 disposed at opposite lower end portions of the receptacle portion T1 of the apparatus housing T in the similar manner as in the embodiment of FIG. 1. The construction and function of the photoreceptor 1 and the corona charger 2 are similar to those of the embodiment of FIG. 1, so that description thereof is abbreviated for brevity. Additionally, in this modification, the stationary platform 3 for the original 4 and the reciprocating curved mirror 5 enclosing the light source L therein described as employed in the embodiment of FIG. 1 are respectively replaced by a transparent platform 3' horizontally, reciprocatingly supported at the upper portion of the apparatus housing T, and a reflecting shade 5' having a surface 5*a* of the secondary degree and fixedly disposed below and adjacent to the platform 3' with the light source L enclosed therein for illuminating the original 4 through the surface 5*a*. The image light rays from the original 4 thus illuminated are directed, through the image transmitter 7, onto the photosensitive surface 1*a* of the photoreceptor drum 1 preliminarily charged by the corona charger 2 for forming the electrostatic latent image on the surface 1*a* in the similar manner to that described in the embodiment of FIG. 1.

As the drum 1 rotates, the latent image formed portion of the photosensitive surface 1*a* reaches the developing device Ac of cascade type, whereat the latent image is developed into a visible toner powder image. The developing device Ac disposed at the left portion of the unit casing Pc1 in FIG. 5 adjacent to the photoreceptor drum 1 extends across the width of the photoreceptor surface 1*a* and enclosed in a housing Ac1 which is formed with an opening G' adjacent to the photoreceptor surface 1*a* and is also cummunicated with the toner dispenser 20 at the left portion of the casing Pc1, and in which developing material comprising the magnetizable carrier material and electroscopic toner powder is accommodated. At the right upper portion of the housing Ac1 adjacent to the opening G', a developing material pickup roller R1 is rotatably disposed with another roller R2 for transportation of the developing material also being rotatably disposed immediately below the roller R1. The pickup roller R1 further comprises an outer cylinder 9*a* of nonmagnetic material such as aluminum or brass which is suitably supported for rotation between the front and rear walls 31 of the unit casing Pc1, and three stationary bar magnets $m_1$, $m_2$ and $m_3$ (FIG. 6) enclosed in the outer cylinder 9*a* with the magnets $m_1$, $m_2$ and $m_3$ being spaced from each other at an angle of about 90° from each other and fixedly mounted on a bar 10*a* suitably secured to the front and rear walls 31 of the casing Pc1, while the roller R2 further includes a rotatable outer cylinder 9*b* of similar material and construction to the roller R1, in which roller R2, three stationary bar magnets $m_4$, $m_5$ and $m_6$ (FIG. 6) spaced at an angle of approximately 90° from each other and fixedly mounted on a bar 10*b* are enclosed in the similar manner to the magnets $m_1$, $m_2$ and $m_3$ of the roller R1. Toner powder 19 stored in the toner dispenser 20 is stirred by the stirrer vane 18 and simultaneously fed into the developer housing Ac1 by the toner supplying magnetic roller 17 which is provided with a plurality of magnetic poles (not shown) around the outer periphery thereof and is adapted to rotate only during operation of the developing device Ac, and is subsequently stirred by the developing material stirring vane 16 for sufficient mixing with the carrier material. The developing material thus replenished with the toner powder is accumulated on the plate 15 disposed below the roller R1 for being attracted onto the outer cylinder 9*a* and raised through magnetic force of the magnets $m_3$ to $m_1$ as the cylinder 9*a* rotates in the direction shown by an arrow. At the upper right portion of the roller R1 adjacent to the outer periphery of the cylinder 9*a*, whereat the developing material attracted onto the cylinder 9*a* is released from the magnetic force of the magnets $m_1$ to $m_3$, there is disposed a cascade plate 9*c* for dividing the developing material into two paths, thus part of the developing material being cascaded over the photoreceptor surface 1*a* through the surface of the plate 9*c* for developing the latent image formed on the surface 1*a* into a visible toner powder image, while most of the developing material falls, through a space between the outer cylinder 9*a* and the corresponding edge of the plate 9*c*, *onto the roller R2 so as to be attracted to the surface of the cylinder 9b* by the action of the magnets $m_4$ to $m_6$, and is fed back into the developer housing Ac1 as the cylinder 9*b* rotates in the direction of an arrow.

The construction and function of the sheet feed mechanism W, transfer station, sheet separating plate 22, fixing device F and sheet discharging mechanism in the modification of FIG. 5 are similar to those in the embodiment of FIG. 1, so that description thereof is abbreviated for brevity.

After separation of the copy paper sheet in the manner detailed in the embodiment of FIG. 1, the photoreceptor surface 1*a* still having residual toner particles thereon is further discharged by an eraser lamp EL1, disposed adjacent to the lower right portion of the surface 1*a*, in a position subsequent to the separating plate 22 and reaches, as the drum 1 rotates, to the cleaner device Cp of paper web type which is incorporated at the right portion of the unit casing Pc1 adjacent to the photoreceptor drum 1. The cleaner device Cp generally comprises a cleaning paper roll 82 disposed in the central portion of the device Cp, a pressing roll 81 provided at the left portion of the roll 82 with the surface of the roll 81 adapted to contact the surface 1*a* of the drum 1, an intermediate roll 83 disposed below the roll 82 and a take-up roll 84 for the cleaner paper provided at the left portion of the casing Pc1 adjacent to the roll 82, each of which rolls 82, 81, 83 and 84 are mounted for rotation in the direction shown by the arrows on corresponding shafts (not shown) suitably journaled in the front and rear walls 31 of the casing Pc1. The web 80 of the cleaner paper from the roll 82 is directed around the pressing roll 81, being pressed against the surface 1*a* of the drum 1 as the roll 81 and the drum 1 rotate in the directions indicated by the arrows, and is taken up onto the roll 84 through the intermediate roll 83. The paper web 80 is adapted to be taken up onto the roll 84, through a clutch mechanism mentioned later, by approximately 5 mm per one copying operation only during rotation of the photoreceptor drum 1.

Accordingly, when the drum 1 rotates in the direction of the arrow shown in FIG. 5, the pressing roll 81 also rotates in the direction shown by the arrow with the paper web 80 pressed against the surface 1*a* of the drum 1 and the residual toner particles on the surface 1*a* is successively wipe off by the web 80, the web 80 bearing the residual toner particles thereon being subsequently taken up by the roll 84.

In the modification of FIG. 5, the copying operation is repeated in the manner described above.

Referring now to FIGS. 7 and 8 driving mechanism for the above unit casing Pc1 provided with the cascade type developing device Ac is described hereinbelow. It should be noted here that FIG. 7 shows the casing Pc1 as seen facing the rear wall 31 thereof for better understanding of the arrangement of various parts of the driving mechanism. Extending through the rear wall 31 of the casing Pc1, there are rotatably provided a photoreceptor drum driven shaft 100, a developing device driven shaft 104, and a cleaner device driven shaft 101 with a pin fixedly mounted, at the central portion thereof, to the extreme end of each of the corresponding shafts 100, 104 and 101 in a direction normal to the axis of the latter.

On the other hand, extending through the innermost wall of the receptacle portion T1 of the apparatus housing T, there are rotatably provided the photoreceptor drum driving shaft *d*8 having the connecting member 215 thereon, a developing device driving shaft *d*2 with the connecting member 206 mounted thereon, and the shaft *d*12 having the connecting member 224 thereon for driving the cleaner device Cp mentioned earlier, in positions corresponding to and engageable with the driven shafts 100, 104 and 101 of the casing unit Pcl for driving the latter shafts 100, 104 and 101 through driving means (not shown) provided in the apparatus housing T.

Accordingly, rotational force transmitted to the driven shaft 100 of the unit casing Pcl drives the photoreceptor drum 1 secured to the shaft 100, while the rotation transmitted to the shaft 104 rotates a sprocket 105 secured to the shaft 104, which sprocket 105 is connected through a chain 121 to sprockets 106 and 107 fixedly mounted on the shafts of the developing rollers R1 and R2 for rotating the outer cylinders 9a and 9b. The chain 121 is further directed around a sprocket 108 fixed on the shaft for the developing material stirring vane 16 for rotating the vane 16. On the shaft of the vane 16, a gear 109 is also fixedly mounted, so that the rotational force is further transmitted to a gear 112 secured to the shaft of the toner supply roller 17, through an intermediate gear 110 and a gear 111 in mesh with the gear 110, for rotating the roller 17. The gear 112 further engages a gear 113 fixed on the shaft of the toner powder stirring vane 18 for rotating the vane 18. Meanwhile, the rotational force transmitted to the driven shaft 101 of the casing Pcl is further transmitted to a gear 103 secured to the shaft of the paper web take-up spool 84, through paper feeding clutch gears 114, 115, 116 and 117 which are rotatably mounted on a clutch arm 118 so as to engage a gear 103 fixedly mounted on the shaft 101 for rotating the spool 84. The arm 118 with the gears 114, 115, 116 and 117 rotatably mounted thereon is normally urged, through a tension spring 119 which is stretched between the upper end of the arm 118 and the wall 31 of the casing Pcl, in a direction away from the gear 103 secured to the shaft of the take-up spool 84, and is adapted to be displaced, through a solenoid 120 which is actuated only during rotation of the drum 1, to a position where the gear 117 meshes with the gear 103 for rotating the spool 84.

Electrical power for energizing the corona charger 2, the eraser lamps EL1 and EL2, and the solenoid 120 incorporated in the casing Pcl is supplied to the casing Pcl through connection of a socket and a plug (not shown) suitably provided in the casing Pcl and the apparatus housing T.

Referring now to FIGS. 8, 9 and 10, driving system incorporated in the apparatus housing T is described hereinbelow. In FIG. 9, there is disposed a main motor MM approximately in the central portion of the housing T. On the low speed side of the driving shaft *d* of the motor MM, there is fixedly mounted a bevel gear 201 which engages a bevel gear 202 secured to a shaft *d*1 rotatably provided in a direction normal to the axis of the driving shaft *d*. Sprockets 203 and 204 are fixedly mounted on the shaft *d*1 in parallel relation to the bevel gear 202. On the developing device driving shaft *d*2, a sprocket 205 is fixedly mounted in parallel relation to the connecting member 206, which sprocket 205 is connected to the sprocket 203 through a chain 207 for transmitting the rotational force of the motor MM to the shaft *d*2 and the connecting member 206. A connecting member 209 is fixed on a transportation belt driving shaft *d*3 with a sprocket 208 secured to the shaft *d*3 in parallel relation to the member 209. On a rotatory shaft *d*4, a sheet feed roller driving sprocket 210 is fixedly mounted for simultaneous rotation with the sheet feeding rollers through a sheet feeding clutch 244, on which shaft *d*4, a gear 239′ is mounted in parallel relation to the sprocket 210 with the gear 239′ being adapted to engage a gear 240 fixedly mounted on a shaft *d*5 for the manual sheet insertion roller. On the shaft *d*5, a sprocket 241 is fixedly mounted in integral connection with the gear 240, which sprocket 241 is connected to a sprocket 242 fixed on the manually inserted sheet feeding roller shaft *d*6 through a chain 243 for mechanically engaging the gear 239′ with a intermediate gear 239 so as to transmit the driving force to the manually inserted sheet feeding roller only during shet feeding through manual insertion (not shown). A photoreceptor drum driving sprocket 212 is fixedly mounted on the rotatory shaft *d*7 with a sprocket 211 for changing direction fixedly mounted on a rotatory shaft disposed adjacent to the shaft *d*7. On the shaft *d*7, a gear 213 is fixedly mounted in parallel relation to the sprocket 212, which gear 213 is adapted to rotate the connecting member 215 for the photoreceptor drum driving shaft *d*8 through a gear 214 fixedly mounted on the shaft *d*8 in parallel relation to the member 215. A sprocket 217 for advancing the platform 3 is fixedly mounted on the rotatory shaft *d*9 with a sprocket 216 for changing direction which is secured on a rotatory shaft being disposed between the shafts *d*7 and *d*9. On the shaft *d*9, a gear 218 is mounted in parallel relation to the sprocket 217 through a clutch 245 for advancing the platform 3, which gear 218 is adapted to drive the platform 3 in a scanning direction through a toothed rack 220 fixed to a lower surface of the plateform 3 and a gear 219 which engages the rack 220 and which is fixedly mounted on a rotatory shaft *d*10 disposed below the rack 220. A sprocket 221 for driving the platform 3 in the reverse direction is fixedly mounted on a rotatory shaft *d*11 disposed adjacent to the gear 219. On the same shaft *d*11, a gear 222 is secured in parallel with the sprocket 221, which gear 222 drives the platform 3 in the returning direction through a gear 219 and the rack 220. A sprocket 223 for driving the cleaner device Cp is fixedly mounted on the shaft *d*12, on which shaft *d*12 the connecting member 224 earlier mentioned is fixedly mounted in parallel relation with the sprocket 223. On the rotatory shaft *d*13, there is fixedly mounted a heat roller driving sprocket 225 for driving a gear 227 secured on a heat roller shaft *d*14 through a gear 226 fixedly mounted on the same shaft *d*13 in parallel relation to the sprocket 225. A sprocket 229 is fixedly mounted on the heat roller shaft *d*14 in parallel relation with the gear 227, which sprocket 229 is connected through a chain 247 to a sprocket 231 fixedly mounted on a rotatory shaft *d*15 together with a gear 230. The gears 227 and 230 engage gears 228 and 232 integrally formed on corresponding upper rollers for rotating the upper rollers. A sprocket 233 for changing direction is secured on a shaft rotatably provided in the vicinity of the motor MM, and a roller chain 234 which is directed around the sprockets 203, 208, 210, 211, 212, 216, 217, 221, 223, 225 and 233 is driven in the direction of an arrow shown in FIG. 9 for rotating these sprockets. On the high speed side of the driving shaft *d* of the motor MM, there is fixedly mounted a pulley 235 which is connected to the cleaner brush driving pulley 237 fixedly mounted on a rotatory shaft *d*16 through a belt 238 for driving the pulley 237 with the belt 238 also directed around a rotatory pulley 236 for changing direction.

Referring to FIG. 10, when the unit casing Pcl, for example, is inserted into the receptacle portion T1 of the apparatus housing T, the photoreceptor drum driven shaft 100, the developing device driven shaft 104 and the cleaner device driven shaft 101 extending through the rear wall 31 of the casing Pcl engage the connecting member 215 of the photoreceptor drum driving shaft *d*8, the connecting member 206 of the developing device driving shaft *d*2 and the connecting member 224 of the cleaner device driving shaft *d*12 respectively and the driving force form the main motor MM is transmitted to the internal mechanisms of the unit casing Pcl. At the lower portion of the casing Pcl adjacent to the positioning member 33, there is fixed a plug *tm* for connection with a socket (not shown) provided on the apparatus housing T for actuating the electrical system incorporated in the casing Pcl.

Referring now to FIGS. 5 and 11, the electrical control circuit of the copying apparatus of the invention is described hereinbelow.

Upon closure of a main switch MSW, a pilot lamp PL and the fixing device F are ennergized, in which case, function of the fixing device F is actually controlled through a temperature controller T*c* which is connected in series with the fixing device F.

When a print switch SW is pressed to be turned on, a relay RL1 is energized and self-retained through a contact IS4, while a relay RL2 is simultaneously energized through a contact $1S_2$ with the relay RL2 consequently self-retained through a contact $2S_2$, thus the main motor MM, the eraser lamp EL1 and a high voltage source HT being energized, which high voltage source HT supplies electric power to the corona charger 2 and the transfer charger 44 respectively. Accordingly, the exposure lamp L is turned on through the contact $1S_4$ of the relay RL1, while the electromagnetic clutch 245 for advancing the platform 3′ is energized through a contact $1S_3$ and the platform 3′ starts moving in the scanning direction. Simultaneously, the sheet feeding clutch 244 is also energized through the contact $1S_3$ so as to start feeding of a copy paper sheet, and when a leading edge of the copy paper sheet depresses a movable contact arm of a microswitch MSF disposed in a path of the copy paper sheet, the sheet feeding clutch 244 is de-energized and stops functioning.

Upon termination of the exposure of the light image of the original onto the photoreceptor surface 1*a* as the platform 3′ moves, the platform 3′ contacts a movable contact arm of a microswitch MS2 for opening the contact of the switch MS2, and subsequently, the self-retained relay RL1 is re-set with the exposure lamp L turned off and with the contact $1S_2$ switched-over, thus the clutch 254 for advancing the platform 3′ being de-energized while the clutch 246 for returning the platform 3′ is energized. Accordingly, the platform 3′ starts moving in the direction of returning with the eraser lamp EL2 turned on through the contact $1S_1$, in which case, since the corona charger 2 still remains "on" with the outer cylinders 9*a* and 9*b* for the developing rollers R1 and R2 being driven through the main motor MM, development on the undesirable portion of the photoreceptor surface 1*a* is eliminated, thus unnecessary consumption of toner powder and extra load to the cleaning device C for removing excessive tone powder being advantageously prevented.

Thereafter, the platform 3′ returns to a predetermined position and actuates a microswitch MS1 for energizing the relay RL3. Accordingly, a capacitor C1 is discharged through the contact $3S_2$, which discharging actuates a timer relay TR in the form of pulse signals. The timer relay TR is adapted to function only during a single sheet copying and is set up to a time at which a copy paper sheet of a maximum copying size is discharged onto a tray (not shown). When the relay RL2 is de-energized through the timer relay TR at a predetermined set time, the relay RL2 is released from self-retaining with the main motor MM, the erasing lamp EL1 and the high voltage source HT being de-energized, and the copying apparatus completing one copying cycle is ready for subsequent copying operation.

In a continuous reproduction of a plurality of copy paper sheets, the portion surrounded by a dotted line in FIG. 11 functions as a sheet counter, in which portion a switch CSW1 is connected in parallel with the print switch SW for being turned on or off through a solenoid SOL1, and a rotary switch CSW2 driven by the solenoid SOL1 is connected to a charging circuit composed of capacitors C1 and C2. On the supposition that the number of copy paper sheets to be taken is set at N sheets, the capacitor C2 is charged through the contact $3S_3$ of the relay RL3 during advancement of the platform 3′, and upon subsequent returning of the platform 3′, the microswitch MS1 is closed with the capacitor C2 discharged through the contact $3S_3$ and with the solenoid SOL1 self-retained for a predetermined period of time, in which case, the switch CSW1 is closed as in the closure of the print switch SW, and simultaneously the movable contact of the rotary switch CSW2 advances by one step with sequential movement thereof up to a contact (N-1) for subsequent copying operation. Although the advancement of the movable arm of the switch CSW2 is repeated in the similar manner as described above, the capacitor C2 is not charged when the last one copy paper sheet is to be copied, so that the solenoid SOL1 is not actuated thereafter with the copying operation completed thereat.

In the case of copy paper sheet feeding through manual insertion, the manual insertion table 42 which also serves for a cover plate is turned about the axis 0 up to an opened position shown by a dotted line in FIG. 5 with consequent switching-over of a contact of a manual insertion microswitch MS3 for cutting off the circuit of the print switch SW therefrom, and simultaneously the intermediate gear 239 is engaged with the gear 239′ of the manual sheet feeding shaft for driving the feeding rollers 39.

As is clear from the foregoing description, in the copying apparatus of the invention, the exchangeable unit casing Pc or Pcl is adapted to be readily connected with and driven by the driving mechanism provided in the apparatus housing T, so that the copying apparatus can be used as magnetic brush developing type or cascade developing type, depending on the requirements through mere insertion of either the unit casing Pc provided with the magnetic brush type developing device or the unit casing Pcl equipped with the cascade type developing device into the apparatus housing. Furthermore, since such unit casings of different developing type can selectively be inserted into the copying apparatus having a stationary original platform or that having a reciprocating original platform, it is easy to provide a versatile copying apparatus through proper combination of the apparatus housing and the pertinent unit casing, by which arrangement, a copying apparatus having developing system suitable for the purpose is very efficiently available for employment.

The incorporation of the three major elements, i.e., the photoreceptor drum, the developing device and the cleaning device, into one unit casing is particularly advantageous in maintenance and repairing of such major elements or in replacing expendable parts thereof, since the apparatus can immediately be used through replacement of such an old unit with a separately prepared new unit, and the inconveniences on the part of the user that the apparatus can not be used during such maintenance, repairing or replacing work can substantially be eliminated.

Additionally, since the photoreceptor, the developing device and the cleaning device are integrally incorporated into one unit casing, not only positioning members determining relative positions of these elements are unnecessary, but functioning accuracy of the entire copying apparatus is markedly improved, and moreover, readiness in assembling and adjustment of such units makes it possible for copying apparatuses to be mass produced with good productivity. It is another advantage of the copying apparatus of the invention, from the point of view of economy and saving of various resources, that the unit used for a predetermined period of time can be collected by the manufacturer of such units for relamation of the same.

Referring now to FIGS. 12 through 21, there is shown another modification of the embodiment of FIG. 1. In this modification, the sheet feed device W described as employed in the embodiment of FIG. 1 is replaced by a modified sheet feed device W′ mentioned below. Other construction and function of they copying apparatus T is the same as those in the embodiment of FIG. 1, so that description thereof is abbreviated for brevity.

Referring particularly to FIG. 12, the sheet feed device W' of the invention disposed at the left lower portion 301 of the apparatus T generally comprised a first sheet feed roller 302 which is mounted on a shaft suitably journaled in frames (not shown) of the copying apparatus T and which is rotated through actuation of a microswitch SW or the print button (not shown), an automatic sheet feed casing 310 in which a stack of copy paper sheets are accommodated, and a guide plate or table 340 for manual insertion of the copy paper sheets. The portion 301 is further provided with an auxiliary manual paper feeding roller 303 adjcent to the guide plate 340, which roller 303 is adapted to rotate through actuation of the main switch (not shown) of the apparatus T.

As is shown in FIGS, 15 and 16, the casing 310 for the automatic paper feeding further comprises a base 311 of a rectangular box-like configuration open at top thereof, and a container 330 placed on a support plate 321 and accommodated in the base 311. The base 311 includes a bottom wall 311*a*, long side walls 311*b* and short side walls 311*c* and 311*d*, and part of the bottom plate 311*a* is raised at the side thereof adjacent the short side wall 311*c* to formed a stepped portion 312 in the base 311 as seen in FIG. 16. A positioning projection 313 extends inwardly at right angles from an inner surface of each of the side walls 311*b* in positions adjacent to the side wall 311*d* with an opening 314 and an arcuate groove 315 being formed in each of the side walls 311*b* in positions adjacent to the projection 313. A shaft 316 which is to be journaled at the opposite ends there of in the corresponding openings 314 is further provided with a pair of stopper plates 317 fixedly mounted at upper portions thereof on the shaft 316 in positions adjacent to the opposite ends of the said shaft 316 with the plates 317 fixedly mounted at the lower portions thereof on a releasing shaft 319 disposed in a direction parallel to the axis of the shaft 316 as shown in FIG. 16. When the opposite ends of the shaft 316 are received in the openings 314 for pivotal movement, the corresponding ends of the shaft 319 extended through the arcuate grooves 315 for sliding movement is said grooves 315.

The support plate 321 comprises a guide plate 322 and a bottom plate 326 hingedly supported at one side edge thereof to the guide plate 322 as at 325, and the guide plate 322 is provided, adjacent to three side edges thereof, with corresponding adjusting plates 324 conventionally known each of which is adapted to slide along a pair of guide grooves 323 formed in the plate 322 in a direction normal to each of the side edges of the plate 322. From one side edge of the bottom plate 326, i.e., the edge thereof in parallel relation to one of the side walls 311*b* of the base 311, a guide wall 327 of generally a triangular configuration having oblique sides 328*a* and 328*b* extends upwardly at right angles, while a projection 329' extends downwardly at right angles from the same edge of the plate 326 in a position adjacent to the front edge of the plate 326 remote from the hinged edge thereof, from which projection 329', a pin 329 extends outwardly in a direction normal to the surface of the projection 329' for engaging a recess 318 formed at an upper forward portion of the stopper plate 317 (FIG. 20).

The container 330 further comprises a box portion 331 for accommodating therein copy paper sheets, and a support plate 332 hingedly supported at one edge thereof to a corresponding edge of the box portion 331 as at 333 (FIG. 16). The support plate 332 has side walls 332*a* upwardly extending at right angles from opposite side edges of the plate 332. On each of the front edges 332*b* of the side walls 332*a*, a paper feeding claw member 334 of triangular cross section which has a claw 334*a* extending inwardly at approximately right angles from the upper edge of the member 334 and which is formed, on one side face thereof contacting the outer surface of the side wall 332*a*, with a vertically aligned elongated slot 335 is slidably attached through a pair of pins 336 to the side wall 332*a* as most clearly seen in FIG. 17 with a notched portion 332*c* formed in each of the side walls 332*a* in a position adjacent to the front edge 332*b* of the wall 332*a*.

For assembling the automatic sheet feed casing 310, the guide plate 322 of the support plate 321 is suitably secured to the stepped portion 312 of the base 311, while there is provided a compression spring 320 between the bottom plate 326 of the support plate 321 and the bottom plate 311*a* of the base 311. When the plate 326 is depressed against the force of the spring 320 till the plate 326 contacts the positioning projections 313, the pin 329 of the plate 326 engages the recess 318 of the stopper plate 317, and the plate 326 is held in position with the under surface thereof contacting the projections 313 (FIGS. 19 and 20). The container 330 is subsequently placed on the support plate 321 with the container portion 331 of the former placed on the guide plate 322 of the support plate 321 and with the container 331 held in position by the adjusting plates 324 which are slidable depending on the size of the container 331 (FIG. 16).

Referring particularly to FIG. 21, the guide table 340 for manual sheet insertion comprises a second guide plate 345, and a first guide plate 341 hindgedly supported at the lower edge thereof to one corresponding edge of the second plate 345 as at 344, which first guide plate 341 can be turned through an angle of approximately 90° about the hinged portion 344. In the first guide plate 341, in positions adjacent to each of the side edges of the plate 341, there are formed a pair of spaced elongated slots in directions normal to each of said side edges, and a sheet width adjusting plate 342 of triangular cross section is slidably attached on each side of the first plate 341 through said pair of slots 343, for example, by pins (not shown), so that distance between the plates 342 can be adjusted depending on the width of the copy paper sheet to be held therebetween. Adjacent to the forward edge of the second guide plate 345, i.e., the edge thereof remote from the hinged portion 344, there is rotatably mounted, close to the under surface of the plate 345, a first press roller 346 for manual sheet insertion, which roller 346 is adapted to contact the first sheet feed roller 302 under pressure through a slot formed in the corresponding position of the plate 345, while in the rear edge of the plate 345 in a position adjacent to the hinged portion 344, there are rotatably provided, close to the under surface of the plate 345, a pair of second press rollers 347 for manual sheet insertion, which second press rollers 347 are adapted to contact under pressure the auxiliary manual paper feeding roller 303 through slots formed in the corresponding positions of the plate 345. On a side edge of the plate 345 adjacent to the rollers 346, there is formed a depending portion 348' extending downwardly at right angles from said side edge, on which depending portion 348', a press roller 348 is rotatably mounted for contact under pressure with the oblique side 328*a* of the wall 327 of the support plate 321, while a pair of auxiliary rollers 349 are rotatably provided under the plate 345 between the press roll 348 and the rollers 347 in directions parallel to the rollers 347 with part of the peripheries of the rollers 349 extending outwardly from the surface of the plate 345 through corresponding slots formed in the plate 345. The above described guide table 340 for manual sheet insertion is adapted to be slidably received in the apparatus housing T through guide members 305 suitably secured to side frames (not shown) of the housing T. As shown in FIGS. 14 and 21, there is provided a microswitch SW in the apparatus T in a position below the second plate 345 of the guide table 340 with the actnator arm 351 of the microswitch MSP extending through a slot 350 formed in the plate 354 and projecting from the surface of the plate 345 to a certain extent, which arm 351, when depressed by the copy paper sheet upon manual insertion thereof, is adapted to actuate the microswitch MSP for driving the first feeding roller 302. For holding copy paper sheets in place, a press plate 306 is provided in the apparatus housing T (FIG. 21).

By this arrangement, in a state where the guide table 340 is in the leftmost position with the first guide plate 341 thereof being in the vertically raised position as shown in FIGS. 12 and 13, when the automatic sheet feed casing 310 equipped with the container 330 and loaded with copy paper sheets of predetermined sizes is inserted into the left lower portion 301 of the apparatus housing T, the ends of the releasing shaft 319 extending through the arcuate grooves 315 of the base 311 contact a pair of projections 304 (FIGS. 18 and 20) provided in the corresponding positions of the apparatus housing T, and upon insertion of the casing 310 to a predetermined position into the portion 301 of the housing T, the stopper plates 317 rotate clockwise about the shaft 316 thereof with the pin 329 of the support plate 321 consequently disengaged from the recess 318 of the stopper plate 317, and the support plate 332 of the container 330 together with the bottom plate 326 of the plate 321 is turned upward about the hinged axes 333 adn 325 of the container 330 and the plate 321 by the urging force of the spring 320, thus the surface of the copy paper sheet contacting the first sheet feed roller 302. Accordingly, upon depressing the print button (not shown), the copy paper sheet P is fed forward one sheet by one sheet from the top of the stack thereof as shown in FIG. 13.

In the manual sheet insertion, when the first guide plate 341 held in the vertical position as in FIGS. 12 and 13 is turned countercloskwise about the hinged axis 344 to a fully opened position which is in alignment with the surface of the second guide plate 345 and is subsequently pushed into the portion 301 of the apparatus housing T to a position shown in FIG. 14, the press roller 348 of the plate 345 is driven onto the oblique side 328*a* of the wall 327 of the support plate 321, thus depressing the support plate 332 of the container 330 for releasing the copy paper sheet from the contact with the first feed roller 302. Subsequently, the press roller 346 for manual sheet insertion contacts the first sheet feed roller 302 as shown in FIG. 14, in which state, upon insertion of a copy paper sheet through the guide table 341, the auxiliary sheet feed roller 303 continuously rotating feeds the copy paper sheet forward, and the leading edge of the copy paper sheet actuates the microswitch MSP, which in turn rotates the first sheet feed roller 302 for feeding the copy paper sheet further forward. It is to be noted that, although the container 330 is depressed downward by the press roll 348, the former is not locked in position, since the stopper plate 317 contacting the projections 304 is in a dispaced position as shown by the chain line in FIG. 20. Accordingly, for reverting to the automatic sheet feeding, the manual sheet insertion table 340 has only to be returned to the original state wherein the guide plate 341 thereof is in the vertical position as shown in FIGS. 12 and 13, in which case the plate 332 of the container 330 of the automatic sheet feed casing 310 together with the bottom plate 326 of the plate 321 is turned upward about the hinged axes 333 and 325 through the action of the spring 320 with the surface of the copy paper sheet contacting the first sheet feed roller 302 ready for atuomatic sheet feeding.

It is needless to say that means for engaging the plate 332 with or releasing the same from the base 311 and the method for driving the first sheet feed roller 302 are not limited to those described as employed in the modification of FIGS. 12 to 21, but that various means may be adopted within the scope of the invention;

As is clear from the foregoing description, in the sheet feed device W' of the invention, driving mechanism thereof is much simplified since both the hand insertion sheet feeding and the automatic sheet feeding can be carried out by one sheet feeding driving roller. Furthermore, the change-over from the automatic sheet feeding to the manual insertion sheet feeding or vice versa is effected by one operation through mere insertion or withdrawal of the manual sheet insertion table into or from the apparatus, thus contributing to the efficient operation of the copying apparatus in actual use to a large extent.

It should also be noted that the sheet feed device W' described as employed in the apparatus of FIG. 1 may also be applicable to the apparatus of FIG. 5 or to any other copying apparatuses in which efficient and accurate changing-over from the automatic sheet feeding to the manual insertion sheet feeding or vice versa is required.

Although the present invention has been fully described by way of example with reference to the attached drawings, it is to be noted that various changes and modifications are apparent to those skilled in the art. Therefore, unless otherwise such changes and modifications depart from the scope of the present invention, they should be construed as included therein.

What is claimed is:

1. In an electrophotographic copying apparatus comprising a photoreceptor having a photoconductive outer surface which photoreceptor is rotatably disposed and movable along a path relative to a plurality of processing stations, such as a corona charging station provided with corona charging means for preliminarily charging said photoconductive outer layer of said photoreceptor, an exposure station including illuminating means for an original to be copied and an optical system for directing a light image of said original onto said preliminarily charged photoconductive surface of said photoreceptor so as to form an electrostatic latent image of said original on said photoconductive surface, a developing station including developing means for developing said latent image into a visible toner powder image, a transfer station including means for transferring said toner powder image onto a transfer material which is fed to said transfer station through a transfer material sheet feed device, and a cleaning station including means for removing residual toner particles on said photoconductive outer surface of said photoreceptor, and a fixing station following said transfer station in the path of the transfer material and including a fixing device for fixing said transferred visible toner powder image on said transfer material, an improvement of said copying apparatus for facilitating maintenance, repairs and replacing components thereof comprising: a unit casing in which said photoreceptor, said developing means and said residual toner removing means are integrally and operatively incorporated, and a receptable portion formed in said housing of said copying apparatus for releasably receiving said unit casing.

2. An electrophotographic copying apparatus as claimed in claim 1, wherein said original is placed on a transparent platform which is horizontally supported on an upper portion of a housing of said copying apparatus, and said illuminating means and said optical system are disposed above said unit casing between said platform and said photoreceptor in said copying apparatus housing.

3. An electrophotographic copying apparatus as claimed in claim 1, wherein said transfer material feed device, said transfer station and said fixing station are disposed below said unit casing in said copying apparatus housing.

4. An electrophotographic copying apparatus as claimed in claim 1, wherein said unit casing is provided with positioning means which slidably engages guide shaft means provided in corresponding position in said receptacle portion for being releasably received in said receptacle portion, said photoreceptor, said developing means and said residual toner removing means each being provided with connecting means which is engageable, upon insertion of said unit casing into said receptacle portion, with a corresponding driving shaft provided in said receptacle portion and associated with driving means for driving said photoreceptor, said developing means and said residual toner removing device, and which is disengageable therefrom upon withdrawal of said unit casing from said receptacle portion, said unit casing further being provided with electrical connecting means which is connected to a power source in said copying apparatus housing upon insertion of said unit casing into said receptacle portion, and which is disengaged therefrom upon withdrawal of said unit casing from said receptacle portion.

5. An electrophotographic copying apparatus as claimed in claim 1, wherein said photoreceptor, said developing device and said residual toner removing device are arranged approximately in a straight line in said unit casing with said photoreceptor disposed in a central portion of said unit casing.

6. An electrophotographic copying apparatus as claimed in claim 5, wherein said photoreceptor is formed into a drum configuration, and a diameter of said photoreceptor is approximately equal to height of said unit casing.

7. An electrophotographic copying apparatus as claimed in claim 6, wherein width of said unit casing is approximately equal to width of said copying apparatus.

8. An electrophotographic copying apparatus as claimed in claim 1, wherein said developing means is of magnetic brush type.

9. An electrophotographic copying apparatus as claimed in claim 1, wherein said developing means is of cascade type.

10. An electrophotographic copying apparatus as claimed in claim 1, wherein said residual toner removing means is of cleaner brush type associated with suction means.

11. An electrophotographic copying apparatus as claimed in claim 1, wherein said residual toner removing means is of cleaner paper web type.

12. An electrophotographic copying apparatus as claimed in claim 1, wherein said original is placed on a transparent platform which is horizontally supported on an upper portion housing of said copying apparatus, and said platform to place the original to be copied thereon remains stationary with said illuminating means and said optical system which are disposed below and adjacent to said platform reciprocating in a direction parallel to an under surface platform for illuminating said original and for directing light image of said original onto said photoconductive surface of said photoreceptor.

13. An electrophotographic copying apparatus as claimed in claim 12, wherein said optical system comprises a plurality of mirrors and lens assembly arranged to direct said light image onto said photoconductive surface of said photoreceptor.

14. An electrophotographic copying apparatus as claimed in claim 12, wherein said optical system is an image transmitter formed by a bundle of optical fibers.

15. An electrophotographic copying apparatus as claimed in claim 1, wherein said original is placed on a transparent platform which is horizontally supported on an upper portion of a housing of said copying apparatus, and said platform to place the original to be copied thereon is adapted to horizontally reciprocate with said illuminating means and said optical system which are disposed below and adjacent to said platform remaining stationary for illuminating said original and for directing light image of said original onto said photoconductive surface of said photoreceptor.

16. An electrophotographic copying apparatus as claimed in claim 15, wherein said optical system comprises a plurality of mirrors and lens assembly arranged to direct said light image onto said photoconductive surface of said photoreceptor.

17. An electrophotographic copying apparatus as claimed in claim 15, wherein said optical system is an image transmitter formed by a bundle of optical fibers.

18. An electrophotographic copying apparatus as claimed in claim 1, wherein said transfer material sheet feed device comprises a first sheet feed roller rotatably mounted in said copying apparatus housing, an automatic sheet feed casing accommodating a stack of transfer material cut sheets therein, said stack being urged, at a top sheet thereof, to a periphery of said first sheet feed roller by spring means during automatic sheet feeding, a guide table for manual sheet insertion slidably disposed in said copying apparatus housing in position between said first sheet feed roller and said automatic sheet feed casing, said guide table being provided with a second sheet feed roller for manual insertion sheet feeding rotatably mounted therein which second sheet feed roller is adapted to contact said first sheet feed roller for enabling the manual insertion sheet feeding, and releasing means for releasing contact between said first sheet feed roller and said top sheet of said stack of transfer material accommodated in said automatic sheet feed casing during the manual insertion sheet feeding.

* * * * *